US009387694B2

(12) United States Patent
Tamura et al.

(10) Patent No.: US 9,387,694 B2
(45) Date of Patent: Jul. 12, 2016

(54) RECORDING APPARATUS

(71) Applicant: SEIKO EPSON CORPORATION, Tokyo (JP)

(72) Inventors: Tetsuya Tamura, Matsumoto (JP); Narihiro Oki, Matsumoto (JP); Tatsuya Shirane, Shiojii (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/306,088

(22) Filed: Jun. 16, 2014

(65) Prior Publication Data

US 2014/0368594 A1 Dec. 18, 2014

(30) Foreign Application Priority Data

Jun. 17, 2013 (JP) ..... 2013-126342
Sep. 18, 2013 (JP) ..... 2013-193370

(51) Int. Cl.

| | |
|---|---|
| ***B41J 3/60*** | (2006.01) |
| ***B41J 13/00*** | (2006.01) |
| ***B41J 3/62*** | (2006.01) |
| ***B41J 11/00*** | (2006.01) |

(52) U.S. Cl.

CPC .... *B41J 3/60* (2013.01); *B41J 3/62* (2013.01); *B41J 11/006* (2013.01); *B41J 13/0045* (2013.01)

(58) Field of Classification Search

CPC ..... B41J 11/006; B41J 3/60; B41J 3/62; B41J 13/0045; B41J 3/54
USPC ..... 347/104, 16, 101, 153
See application file for complete search history.

(56) References Cited

U.S. PATENT DOCUMENTS

| | | | | |
|---|---|---|---|---|
| 7,246,963 | B2 * | 7/2007 | Nishimura | 400/692 |
| 2006/0197819 | A1 * | 9/2006 | Matsui | 347/104 |
| 2013/0286127 | A1 * | 10/2013 | Samoto et al. | 347/104 |

FOREIGN PATENT DOCUMENTS

| | | |
|---|---|---|
| JP | 2004-106278 | 4/2004 |
| JP | 2012-240813 | 12/2012 |

* cited by examiner

*Primary Examiner* — Henok Legesse
(74) *Attorney, Agent, or Firm* — Workman Nydegger

(57) ABSTRACT

A printer includes an apparatus main body including a recording head, and a duplexing unit configured to be removable with respect to the apparatus main body and forming a reverse transport path in which a sheet fed from the recording head side is reversed. The sheet width (for example, width of A4 short side) able to be transported to a region opposing the recording head through the reverse transport path is smaller than the width (for example, width of A4 long side) of the manual supply path, and in a case where the sheet on which recording is performed warps in the width direction, the extent of the warping is restricted to a predetermined range.

16 Claims, 19 Drawing Sheets

RECORDING APPARATUS

BACKGROUND

1. Technical Field

The present invention relates to a recording apparatus, represented by a facsimile, a printer or the like, provided with a feeding portion that feeds a medium to a recording portion and a medium receiving portion that receives the medium discharged from the recording portion.

2. Related Art

A recording apparatus represented by a facsimile, a printer or the like, includes a reverse transport path in which a recording sheet as one example of a medium is reversed, and is able to reverse the recording sheet on which recording is performed, and record on a second surface (rear surface) in addition to a first surface (front surface). The recording apparatus disclosed in JP-A-2012-240813 is configured such that a reversing roller that forms a reversing path in which a recording sheet is reversed is provided in a bending-reversing unit that is attachable and detachable with respect to a recording apparatus main body, and a sheet transport path inside the apparatus is exposed by removing the bending-reversing unit. In the related art, a recording apparatus that includes, for example, a recording portion that records an image including text and figures by ejecting a liquid from a liquid ejecting head with respect to a sheet as one type of a sheet-like medium, and a sheet cassette (first feeding portion) that is able to continuously feed the sheets from on a mounting stand on which a plurality of sheets is able to be mounted in a stacked state to the recording portion has been put into practical use. JP-A-2004-106278 is another example of the related art.

The reverse transport path in which the recording sheet is reversed comparatively easily increases in curvature compared to other transport paths, and paper jams easily occur along the path. In an ink jet printer, warping of the recording sheet occurs by ink being absorbed, because the sheet is bent and reversed in such a non-flat state, paper jams occur much more easily and skewing also easily occurs.

In the related art, although numerous recording apparatuses including a plurality of sheet feed paths and a reverse transport path are provided, special consideration has not been given to the unique problems of a recording apparatus including a plurality of sheet feed paths and a reverse transport path, more specifically, paper jams and the like in the reverse transport path.

SUMMARY

An advantage of some aspects of the invention is to provide a recording apparatus including a plurality of sheet feed paths and a reverse transport path in which the problem of paper jams or the like in the reverse transport path is reduced.

In recent years, there have also been recording apparatuses including a manual feeding portion (first feeding portion) for enabling sheets to be fed one sheet at a time to the recording portion according to manual insertion by a user, in addition to feeding the sheet from the sheet cassette with respect to the recording portion. In a recording apparatus including such a manual feeding portion, a configuration is adopted in which a sheet fed from the sheet cassette and a sheet fed from the manual feeding portion are discharged to the same medium receiving portion.

Therefore, in the recording apparatus, in order for a sheet fed from the manual feeding portion and a sheet fed from the sheet cassette to be received by the same medium receiving portion, the maximum dimensions in the width direction of the sheets fed from both the sheet cassette and the manual feeding portion are made the same. Accordingly, in order to increase the width dimension of the medium able to be fed to the recording portion, it is necessary to form a medium receiving portion with a width dimension of the maximum width or more of the sheets fed from both the sheet cassette and the manual feeding portion. As a result, a problem arises in that the recording apparatus increases in size according to the increase in size of the medium receiving portion.

This situation is generally common to recording apparatuses including a medium receiving portion that receives a medium discharged from the recording portion and including at least two feeding portions that feed media to the recording portion.

Another advantage of some aspects of the invention is to provide a recording apparatus including a plurality of feeding portions that feed media to a recording portion in which increases in size are suppressed and the maximum dimension in the width direction of the medium able to be fed to the recording portion is increased.

According to an aspect of the invention, there is provided a recording apparatus including a first feeding portion that feeds a medium; a recording portion that performs recording on a medium; a first transport path that transports a medium towards the recording portion from the feeding portion, and performs recording on a surface of the medium; a second transport path the is a path for reversing the medium, on the surface of which recording is performed, and recording on the rear surface, and is a branched path from the first transport path, in which the width of the second transport path is narrower than the width of the first transport path.

According to this aspect, since the width of the second transport path is less than the width of the first transport path, in a case where the medium on which recording is performed is warped in the width direction, the medium for which the extent of the warping is small is transported in the second transport path. As a result, it is possible to prevent paper jams in the second transport path (path in which the rear surface of the medium is reversed), or to reduce the frequency thereof.

Additionally, when description is made of an A4 size sheet as one example of the medium, in a case in which the width of the first transport path is set to the size of the long side edge of A4, the A4 size sheet is transported in the first transport path in a state in which the long side direction is set as the width direction (below, referred to as "A4 landscape transport"). On the other hand, in the second transport path, since the width of the medium able to pass through is smaller than that in the first transport path, the A4 size sheet is transported by setting the long side direction to the transport direction (below, referred to as "A4 portrait transport"). That is, since a case of passing through the second transport path is A4 portrait transport, it is possible to suppress skewing compared to A4 landscape transport. Additionally, since it takes time for a region on the rear end side of the sheet to reach the recording portion, it is possible to promote drying of the ink.

It is preferable that the second transport path in the recording apparatus according to the aspect include a reversing path which reverses the medium, and that the reversing path merge with the first transport path.

It is preferable that the recording apparatus of the aspect include a branching portion in which the first transport path branches and which is positioned on the upstream side in the transport direction of the medium with respect to the recording portion during execution of recording.

It is preferable that the recording apparatus of the aspect include a region occupied by the recording portion and the region occupied by the second transport path that at least partially overlap with each other in the thickness direction of the apparatus.

According to the aspect, since the region occupied by the recording portion in the height direction of the apparatus and the region occupied by the second transport path at least partially overlap with each other, it is possible to suppress the dimensions of the apparatus in the vertical direction.

It is preferable that the recording apparatus of the aspect include a branching portion in which the first transport path branches and which is positioned to the downstream side in the transport direction of the medium with respect to the recording portion during execution of recording.

It is preferable that the recording apparatus of the aspect include at least a portion of the second transport path that is formed by a unit that is attachable and detachable with respect to apparatus main body that includes the recording portion.

According to the aspect, since at least a part of the second transport path is formed by the unit that is attachable and detachable with respect to the apparatus main body including the recording portion, at least a portion of the second transport path is exposed by removing the unit, and it is therefore possible to easily remove a jammed medium when a paper jam occurs.

It is preferable that the recording apparatus of the aspects include a second feeding portion that feeds a medium, in which the medium fed via the second feeding portion joins to the second transport path.

According to an another aspect of the invention, there is provided a recording apparatus that performs recording on a medium including an apparatus main body that includes a recording portion that performs recording on a medium; a first feeding portion that includes an insertion port for the medium, and that is able to feed the medium inserted from the insertion port to the recording portion; and a second feeding portion including a mounting stand on which a plurality of sheets of the medium is mountable in a stacked state, and which is able to feed the medium from on the mounting stand to the recording portion. The first feeding portion is provided on a side in the opposite direction to a side where the medium is discharged, the maximum dimension of the medium in the width direction that intersects the feeding direction of the medium fed from the first feeding portion is larger than the maximum dimension of the medium in the width direction that intersects the feeding direction of the medium fed from the second feeding portion.

According to this configuration, it is possible to continuously feed media with a high frequency of performing recording and a comparatively small width dimension to the recording portion by the second feeding portion and to increase the maximum dimension in the width direction of the medium able to be fed to the recording portion by the first feeding portion. Accordingly, for example, since it is not necessary to increase the medium receiving portion included in the recording apparatus, it is possible to obtain a recording apparatus for which an increase in size is suppressed and to increase the maximum dimension in the width direction of the medium able to be fed to the recording portion.

It is preferable that the recording apparatus include a medium discharge port for discharging the medium on which recording is performed to the outside of the apparatus main body, in which the medium discharge port is larger than the width of the second feeding portion.

According to the configuration, even if a sheet with a larger width dimension than a sheet fed from the second feeding portion is fed from the first feeding portion, for example, the sheet is able to be discharged from the medium discharge port with a larger width dimension than the medium receiving portion to outside the apparatus main body. Accordingly, it is possible to obtain a recording apparatus for which an increase in size is suppressed and to increase the maximum dimension in the width direction of the medium able to be fed to the recording portion.

It is preferable that the recording apparatus including a medium receiving portion that receives the medium discharged from the recording portion, in which the dimension of the medium receiving portion in the width direction that intersects the discharge direction of the medium is smaller than the maximum dimension of the medium able to be fed from the first feeding portion in the width direction.

According to this configuration, it is possible to realize a recording apparatus also able to receive a medium fed from the first feeding portion by a medium receiving portion for which an increase in size is suppressed, and possible to reliably receive a medium fed from the second feeding portion in the medium receiving portion.

It is preferable that a medium support portion that supports the medium fed from the first feeding portion from the gravity direction side on both sides in the width direction that intersects the discharge direction of the medium be provided on the medium discharge port.

According to this configuration, in the recording apparatus, it is possible to support both end portions of the medium in the width direction thereof from the gravity direction side with the medium support portion such that the medium fed from the first feeding portion is caused to pass through the medium discharge port. Accordingly, it is possible for the medium fed from the first feeding portion to be reliably discharged to the medium receiving portion.

It is preferable that an inclined location of an uphill slope in which the medium discharged from the recording portion towards the medium discharge port is gradually raised to the antigravity direction side is formed on the medium support portion.

According to this configuration, in the recording apparatus, it is possible to raise both end portions of the medium to the antigravity direction side such that the medium fed from the first feeding portion is caused to pass through the medium discharge port when discharged from the recording portion. Accordingly, it is possible for the medium fed from the first feeding portion to be smoothly discharged to the medium receiving portion.

It is preferable that an operation panel be arranged on a front surface side of the apparatus main body that is the discharge direction side of the medium discharged from the recording portion, and the dimension of the operation panel in the width direction is formed with the same as the dimension in the width of the medium discharge port.

According to this configuration, it is possible to suppress the dimension in the vertical direction (height direction) of a recording apparatus, and make the apparatus thinner by the width of the operation panel being the same as the width of medium discharge port, that is, wider than that of the second feeding portion, while being able to obtain a recording apparatus in which an increase in size is suppressed.

It is preferable that the first feeding portion be a manual feeding portion for manually feeding the medium.

It is preferable that the second feeding portion be a sheet cassette, and a plurality of sheet cassettes be provided in the recording apparatus.

According to this configuration, it is possible to diversify the media able to be fed to the recording portion while being able to obtain a recording apparatus in which an increase in size is suppressed.

It is preferable that a feeding reference position of the medium in the width direction be the center of the feeding portion.

According to the aspect, since the feeding reference position of the medium in the width direction is the center of the feeding portion, it is possible to suppress skewing of the medium along the path.

It is preferable that the recording portion include a liquid supply tube having a moving body that performs recording by ejecting a liquid to a sheet-like medium, guides the liquid sent from a liquid accommodating body in which the liquid is accommodated to the recording portion, and includes a deforming movable portion that deforms so as to follow the movement of the moving body, in which at least a portion of the liquid accommodating body is arranged outside the apparatus main body.

According to this configuration, a recording apparatus is obtained that is able to feed large volumes of a liquid to the recording portion while being able to obtain a recording apparatus in which an increase in size is suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, although an embodiment of the invention is described based on the drawings, the invention is not limited to the embodiments described below and may be modified in various ways within the scope of the invention described in claims. Hereinafter, an embodiment of the invention will be described, and these modifications should be construed as being included in the invention.

Figure 1:
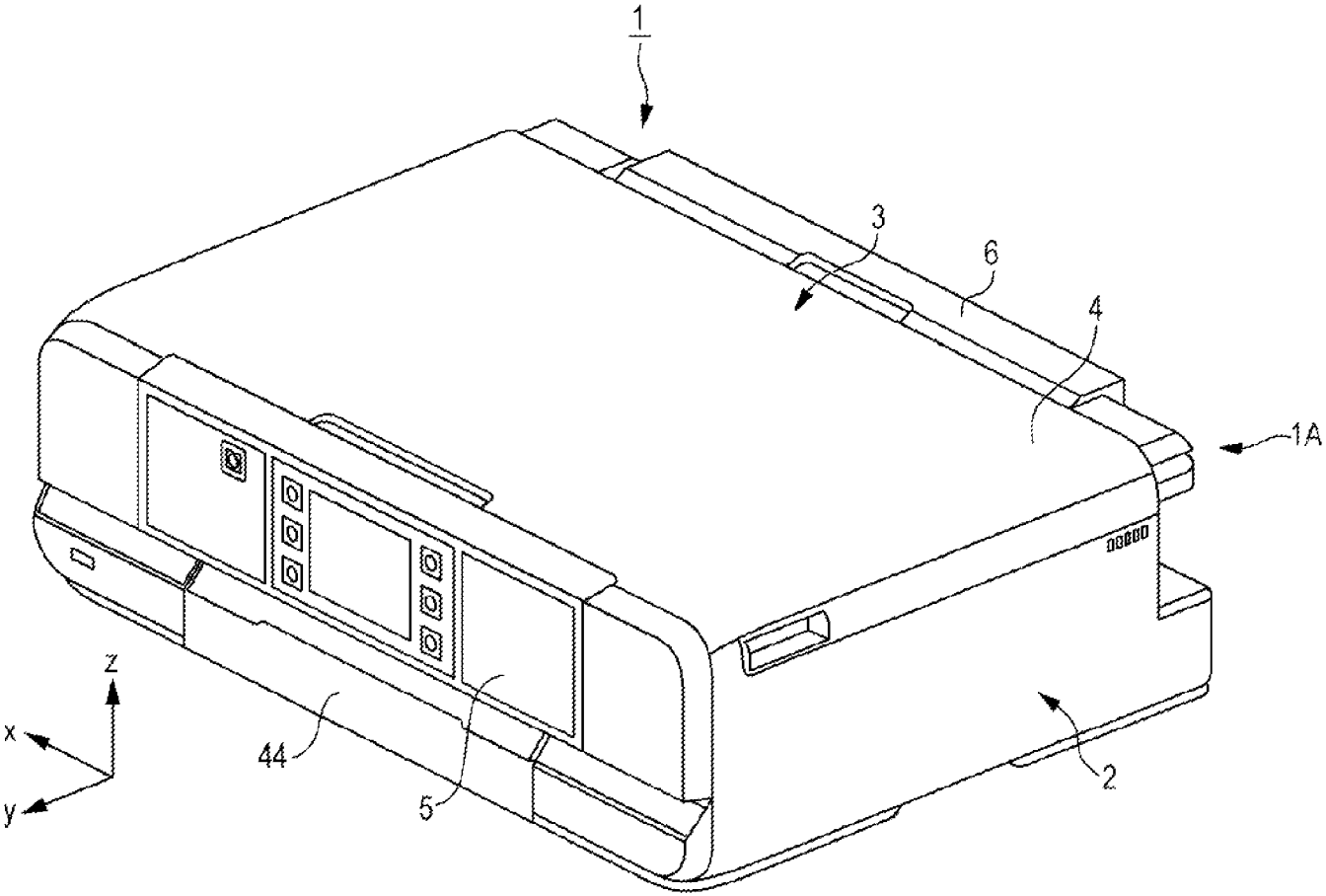
FIG. 1 is an external perspective view of a printer according to the invention viewed from the forward side.
Figure 2:
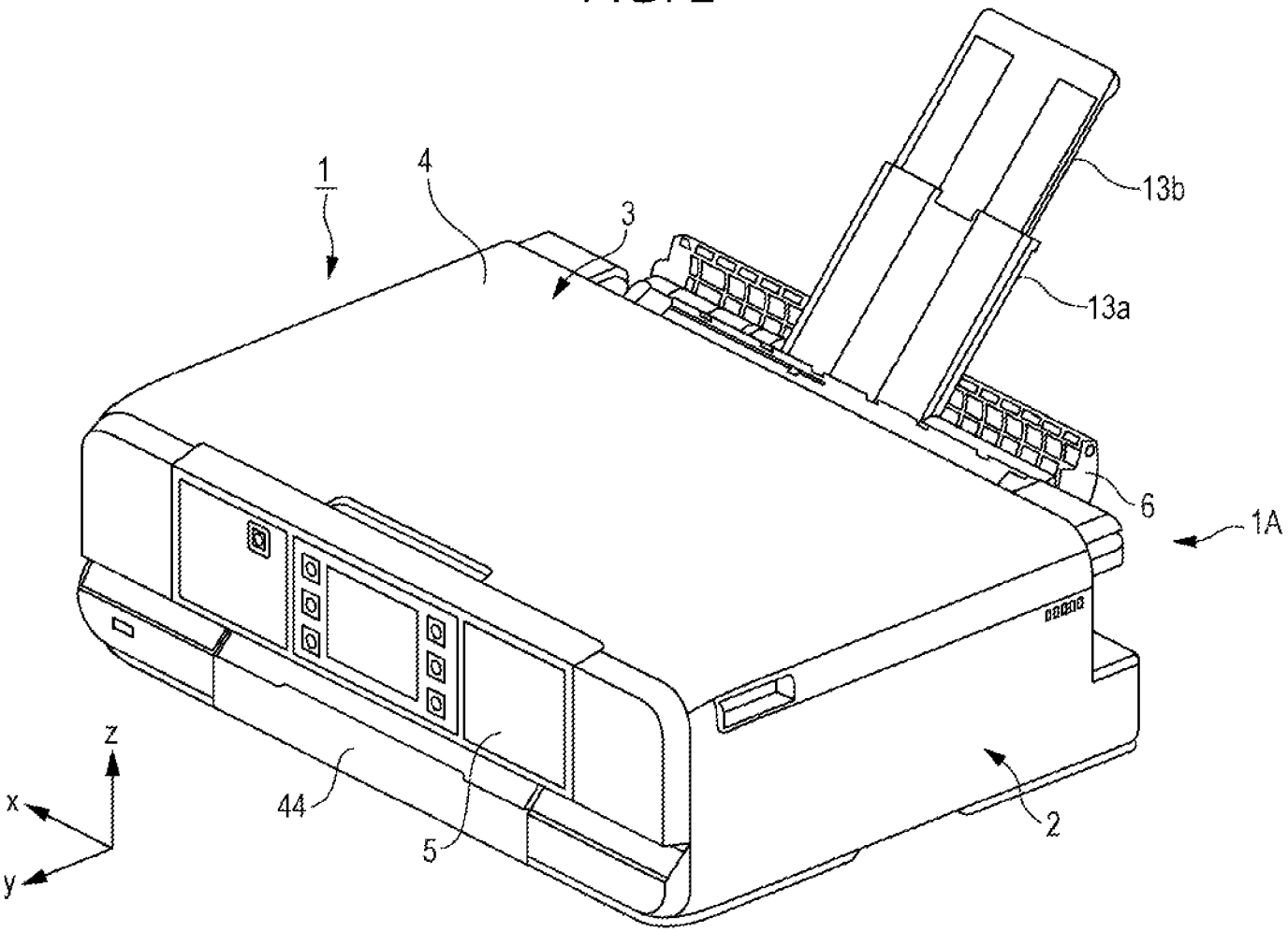
FIG. 2 is an external perspective view of a printer according to the invention viewed from the forward side.
Figure 3:
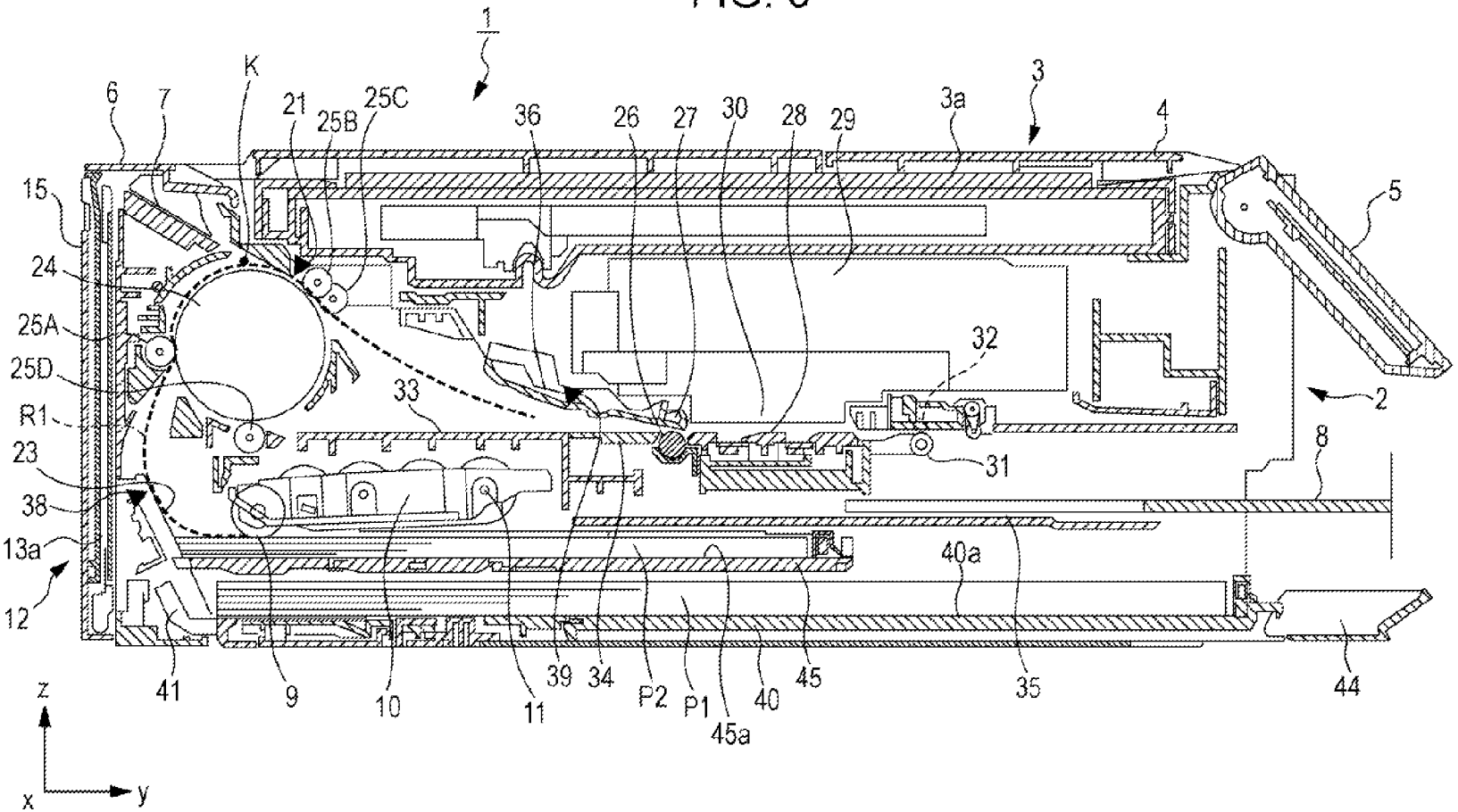
FIG. 3 is a side cross-sectional view showing a sheet transport path of a printer according to the invention.
Figure 4:
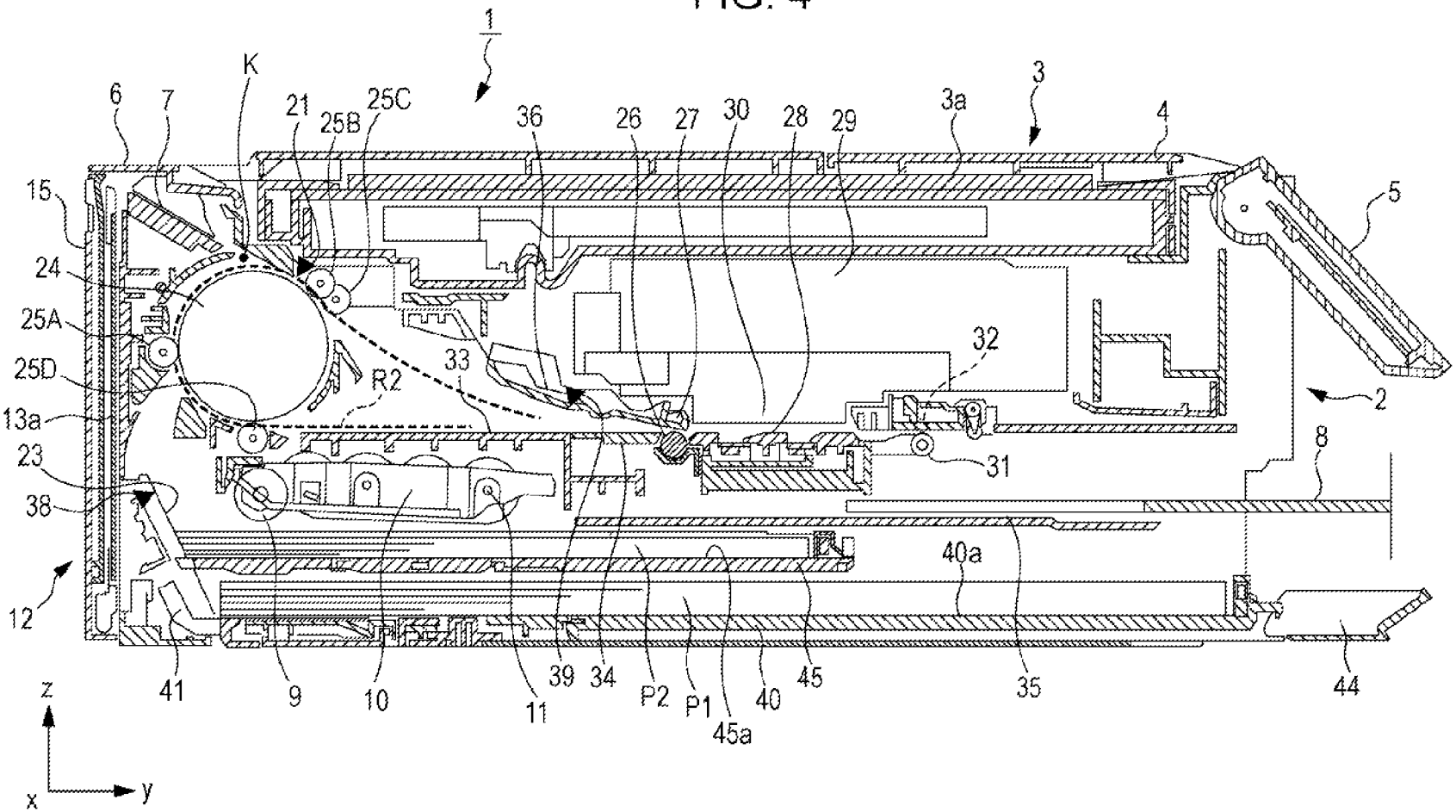
FIG. 4 is a side cross-sectional view showing a sheet transport path of a printer according to the invention.
Figure 5:
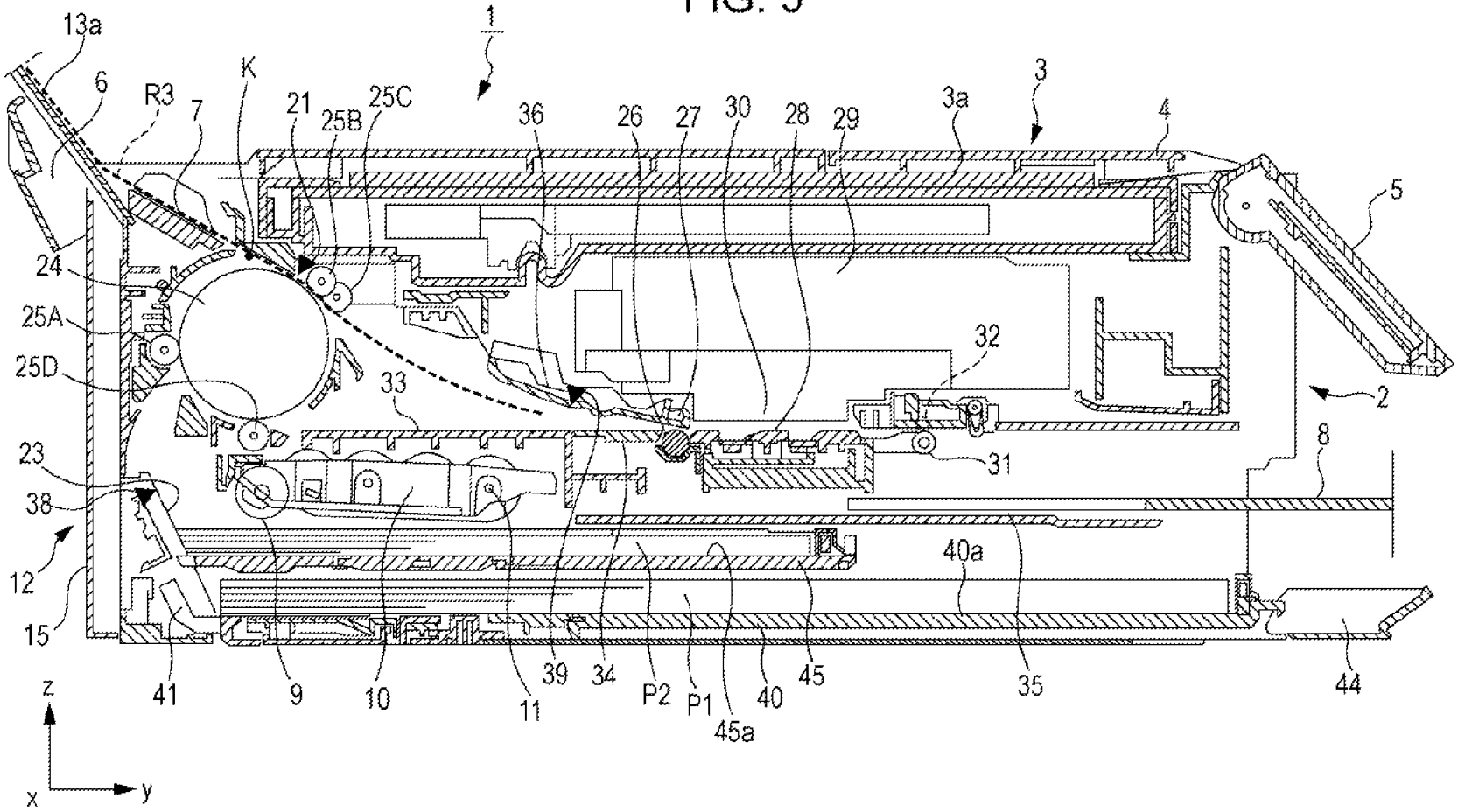
FIG. 5 is a side cross-sectional view showing a sheet transport path of a printer according to the invention.
Figure 6:
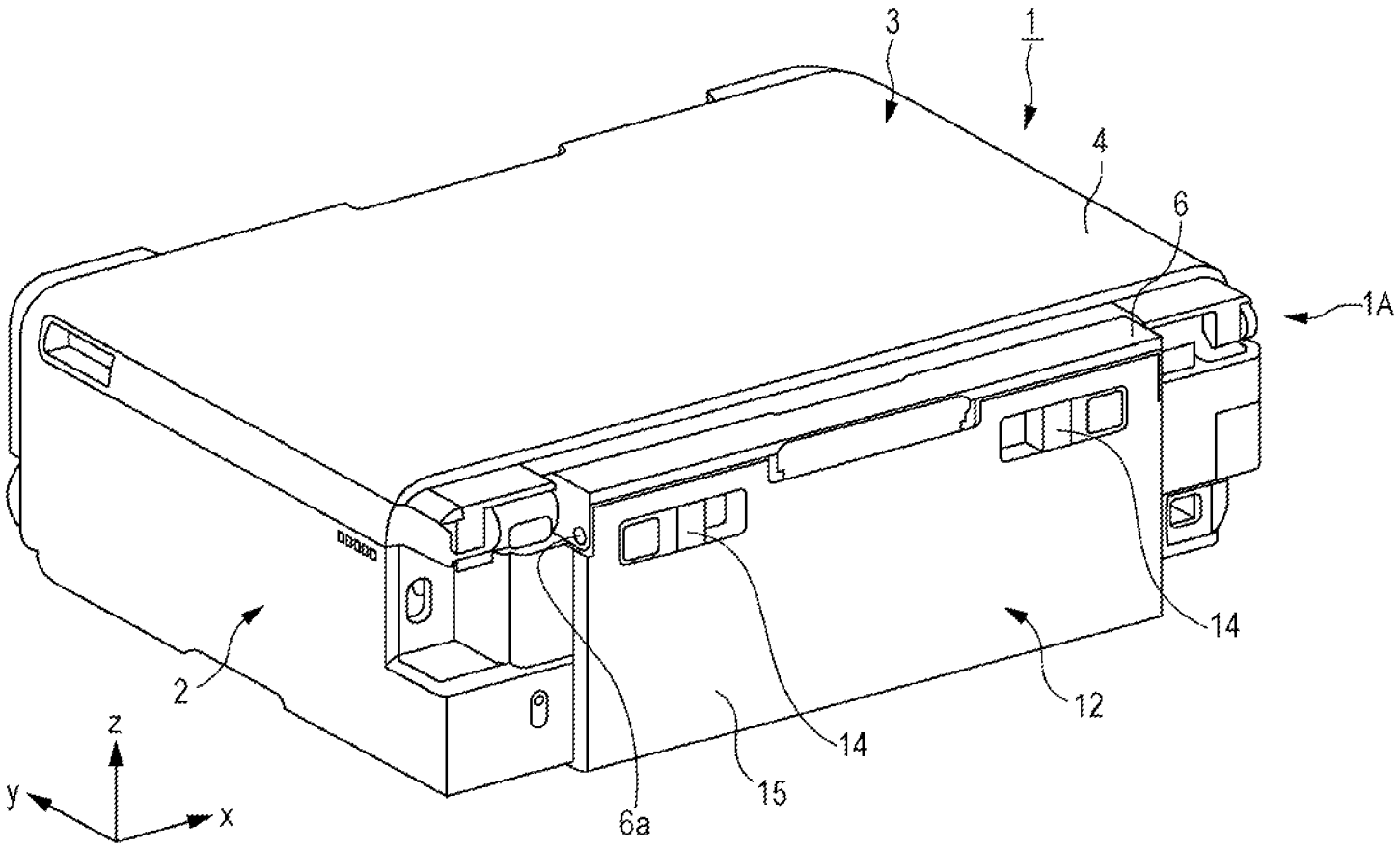
FIG. 6 is an external perspective view of a printer according to the invention viewed from the rear side.
Figure 7:
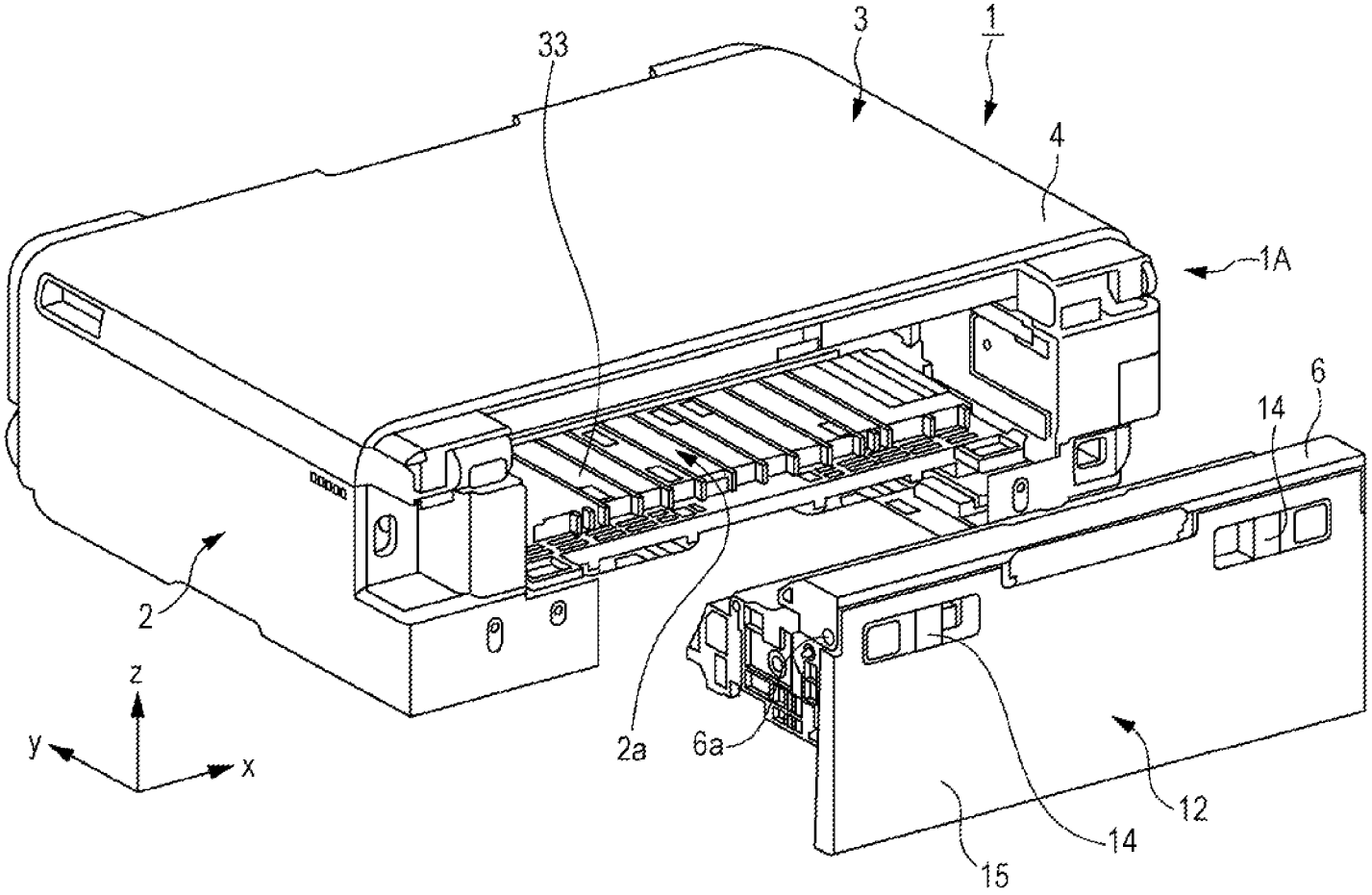
FIG. 7 is an external perspective view of a printer according to the invention with the duplexing unit removed when viewed from the rear side.
Figure 8:
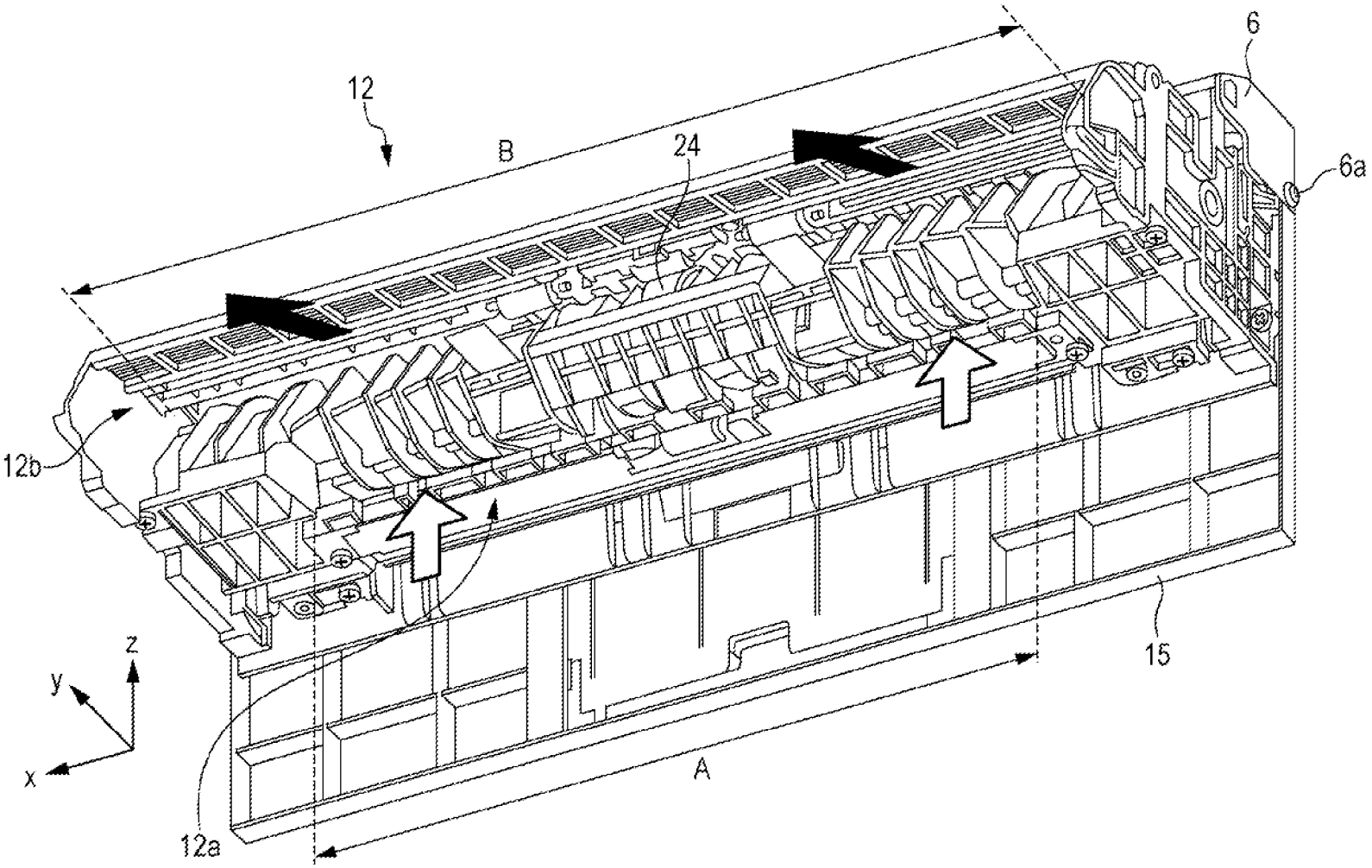
FIG. 8 is a perspective view of the duplexing unit.

FIGS. 1 and 2 are external perspective views of a printer 1 according to the invention viewed from the forward side, FIGS. 3 to 5 are side cross-sectional views showing a sheet transport path of the printer 1, FIG. 6 is an external perspective view of the printer 1 viewed from the rear side and FIG. 7 is an external perspective view of a printer 1 with the duplexing unit 12 removed when seen from the rear side. FIG. 8 is a perspective view of the duplexing unit 12, FIGS. 9A to 10B are drawings each showing a variation of the sheet feed path and the reverse transport path.

In x-y-z Cartesian coordinate system shown in each drawing, the x direction and the y direction are the horizontal directions. Among these, the x direction is the sheet width direction, and further, is also the left to right direction of the apparatus. The y direction is the sheet transport direction in the recording region, and is also the depth direction of the apparatus. The z direction is the gravity direction, and is also the height direction of the apparatus.

Hereinafter, the overall configuration of the printer 1 that is an embodiment of the recording apparatus of the invention will be summarized with reference to FIGS. 1 to 5. The printer 1 in FIGS. 1 and 2 includes a scanner unit 3 on the upper portion of the recording unit 2 that performs ink jet recording on a recording sheet as an example of the medium; that is, the printer 1 is configured as a composite device including a scanner function in addition to the ink jet recording function.

The scanner unit 3 is provided to be rotatable with respect to the recording unit 2, and attains a closed state (FIG. 1) and an open state (not shown) by being rotated.

The upper cover 4 in the scanner unit 3 is a document cover that is openable/closable, and the document platen 3*a* of the scanner unit 3 (FIGS. 3 to 5) appears by opening the cover 4.

The reference numeral 5 on the front surface of the apparatus is an operation panel including a power button and operation buttons that causes various printing settings and recording execution to be performed, and a display portion that performs preview display of the printing set content or a printing image, or the like. The operation panel 5 is provided to be able to tilt and hold a desired angle (posture).

The reference numeral 6 indicates an openable/closable manual cover on the upper rear portion of the recording unit 2, and manual feeding of a recording sheet is performed using the manual supply path (described later) by opening the manual cover 6 as shown in FIG. 2. Upon opening the manual cover 6, paper supports 13*a* and 13*b*, described later, are able to be expanded. The manual cover 6 is provided to be able to rotate with respect to the duplexing unit 12 described later, with a rotation shaft 6*a* (FIG. 6) as a center.

The sheet transport path of the printer 1 will be described in further detail with reference to FIGS. 3 to 5. The printer 1 according to the present embodiment includes a lower tray 40 as a "second feeding portion" and an upper tray 45 as a "second feeding portion" on the bottom portion of the apparatus, and the recording sheets are fed one at a time from the lower tray 40 or the upper tray 45.

The lower tray 40 and the upper tray 45 that are able to accommodate plural recording sheets configure a medium accommodation portion that accommodates media; that is, the medium accommodation portion of the printer 1 is configured from a plurality of medium accommodation trays. The lower tray 40 and the upper tray 45 provided on the upper portion thereof are each independently able to be removed with respect to the recording unit 2.

In FIGS. 3 to 5, sheets accommodated in the lower tray 40 and sheets accommodated in the upper tray 45 are indicated by the reference numerals P1 and P2, respectively (in cases where there is no particular need to distinguish therebetween, referred to as "sheet P").

The upper tray 45 slides (displaces) between an abutting position, that is, a feedable position (FIGS. 3 to 5) and a retreated position (not shown). In the feedable position, a sheet P2 is able to be fed from the upper tray 45. In the retreated position, a sheet P1 is able to be fed from the lower tray 40.

The reference numeral 44 indicates an openable/closable cover provided on the lower tray 40, and the lower tray 40, the upper tray 45 and the discharged paper receiving tray 8 are configured to be exposed to the front surface side of the apparatus by opening the cover 44 as shown in FIGS. 3 to 5.

A feed roller 9 that configures a feeding unit and is driven to rotate by a driving motor, not shown, is provided on a roller support member 10 that swings with a rotation axis 11 as a center, and when the upper tray 45 is in the retreated position, feeds the sheet P1 in the uppermost position from the lower tray 40 by being rotated in contact with the uppermost sheet P1 accommodated in the lower tray 40.

When the upper tray 45 is in the abutting position (feedable position, in FIG. 3), the feed roller 9 feeds the sheet P2 in the uppermost position from the upper tray 45 by being rotated in contact with the uppermost sheet P2 accommodated in the upper tray 45.

A separating inclined surface 23 is provided at a position opposing the leading edge of the lower tray 40 and the upper tray 45 in the recording unit 2, and in a state in which the lower tray 40 is mounted, a stopper 41 provided at the leading edge of the lower tray 40 enters further inward than the separating inclined surface 23, and enters into a state in which the leading edge of the sheet accommodated in the lower tray 40 is able to abut on the separating inclined surface 23.

In the upper tray 45, in a state in which the upper tray 45 is positioned in the feedable position, a stopper (not shown) provided on the leading edge of the upper tray 45 enters further inward than the separating inclined surface 23, and enters into a state in which the leading edge of the sheet accommodated in the upper tray 45 is able to abut on the separating inclined surface 23.

For the sheets P fed from the lower tray 40 or the upper tray 45, separation between the uppermost sheet P to be fed and the sheets P in the second-uppermost and subsequent positions is performed by the leading edge of the sheet proceeding to the downstream side while contacting the separating inclined surface 23.

A sheet detection sensor 38 is provided at a position of the separating inclined surface 23 in the sheet feed path, and in this position is able to detect the leading edge of the sheet P fed from the lower tray 40 and the upper tray 45. Accordingly, regardless of variations in the length of the feed path caused by the different trays during feeding or variations in the length of the feed path caused by the number of sheets accommodated, that is, regardless of the length of the feed path in different conditions, it is possible to ascertain the position of the leading edge of the sheet, and in so doing, appropriately control feeding. The optical sensor 38 in FIGS. 3 to 5 and the optical sensors 21 and 39 described later are depicted as a triangular mark that shows the arrangement position, for convenience of depiction.

An intermediate roller 24 that is driven to rotate by a motor, not shown, is provided forward beyond the separating inclined surface 23, and the sheet P is curved and reversed by the intermediate roller 24, and faces the forward side of the apparatus. The reference signs 25A, 25B, and 25C indicate driven rollers that are able to be driven and rotated. As a matter of course, a sheet P is nipped by the driven roller 25A and the intermediate roller 24, further nipped by the driven roller 25B and the intermediate roller 24, and is fed to the downstream side.

A transport driving roller 26 that is driven to rotate by a motor, not shown, and a transport driven roller 27 that is supported by a roller support member 36 and driven and rotated in contact with the transport driving roller 26 are provided forward beyond the intermediate roller 24. A sheet P is fed to below a recording head 30 that configures the "recording portion" by the rollers.

A guiding member indicated by reference numeral 33 is provided below the intermediate roller 24. The guide member 33 forms a sheet transport path between the intermediate roller 24 and the transport driving roller 26. The reference numeral 34 indicates a guide member that forms a sheet transport path between the guide member 33 and the transport driving roller 26. The reference sign 25D indicates a driven roller that nips the sheet P, which is switched back to the upstream side (left side in FIGS. 3 to 5) from the transport driving roller 26 for duplex printing, with the intermediate roller 24.

A sheet detection sensor 39 is provided in the vicinity of the upstream side of the position of the roller support member 36 in the sheet transport path, specifically the sheet nip position due to the transport driving roller 26 and the transport driven roller 27, and is able to detect the passage of the leading edge or rear edge of the sheet P in this position.

The recording head 30 as a recording unit that discharges ink is provided on the bottom portion of a carriage 29, and the carriage 29 is driven so as to reciprocate in the main scanning direction (front to rear direction of the paper surface in FIGS. 3 to 5) by a motor, not shown.

A support member 28 is provided at a position opposing the recording head 30, and the gap between the sheet P and the recording head 30 is regulated by the support member 28. A discharge driving roller 31 driven to rotate by a motor, not shown, and a discharge driven roller 32 that is driven and rotated in contact with the discharge driving roller 31 are provided on the downstream side of the support member 28. The sheet P on which recording is performed by the recording head 30 is discharged toward the discharged paper receiving tray 8 by these rollers.

The discharged paper receiving tray 8 positioned on the upper portion of the upper tray 45 is provided in a state (not shown) of being accommodated in the recording unit 2 by a motor, not shown, and a state (FIGS. 3 to 5) of being projected to the forward side of the recording unit 2, and is able to receive a recording sheet which is printed and discharged by entering into the state of being projected toward the forward side of the recording unit 2.

The control targets of the feed roller 9, the intermediate roller 24, the transport driving roller 26, the carriage 29, the recording head 30, and the discharge driving roller 31 are controlled by a controller, not shown. The controller is able to ascertain the position and size of the sheet based on the detection signal received from each of the detection units of the sheet detection sensors 38, 21, and 39 arranged at their respective positions in the sheet transport path. In a case in which a paper jam occurs, it is possible to ascertain that a paper jam has occurred between any of the sheet detection sensors. Accordingly, it is possible to sound an appropriate alert with respect to the user.

The sheet detection sensors 38, 21, and 39 are optical sensors in the present embodiment. Each optical sensor is configured to include a light emitting portion and a light receiving portion, not shown. The light emitting portion irradiates the sheet with detection light, and the light receiving portion receives the components of light reflected from the sheet or the sheet transport path from among the irradiation light. The controller is able to detect the passage of the leading edge or rear edge of the sheet by receiving a signal indicating the intensity of light received in the light receiving portion from each optical sensor. Therefore, the part opposing each optical sensor in the sheet transport path is colored, for example, black, so as to have a reflectivity significantly different from the sheet.

Although the above are the main constituent components on the sheet transport path, the sheet transport path includes a reverse transport path (broken line R2 in FIG. 4) as a "second transport path" in which the sheet P, on the first surface (front surface) of which printing is performed, is reversed, and a manual supply path (broken line R3 in FIG. 5) as a "first transport path" to which a sheet is manually supplied via a manual guide portion 7 as a "feeding portion", in addition to the sheet feed path (broken line R1 in FIG. 3) by which the sheet P fed from the above-described lower tray 40 or upper tray 45 is fed.

The reverse transport path R2 is the transport path when the transport driving roller 26 is reversely driven, the rear edge side of the sheet during recording is made the leading edge and transported to between the intermediate roller 24 and the driven roller 25D, then reversed by the intermediate roller 24 and fed between the transport driving roller 26 and the transport driven roller 27 (fed to the recording head 30 side). The reverse transport path R2 includes a reversing path in which the sheet is reversed. The reversing path is formed by the outer peripheral surface of the intermediate roller 24. As is clear from FIG. 4, upon the sheet being fed to the reverse transport path R2 by the transport driving roller 26 being reversely driven, the sheet is again transported to the recording head 30 side by drawing the trajectory shown in FIG. 4. That is, a unit for switching the path is unnecessary, and a cost reduction is achieved.

The manual supply path R3 is a manual supply path partially formed by the manual guide portion 7 that appears by opening the manual cover 6 of the rear upper portion, and by paper supports 13*a* and 13*b* that support the sheet P which is guided by the manual guide portion 7. The manual supply path R3 joins to the reversing path (path formed close to the outer peripheral surface of the intermediate roller 24) in the reverse transport path R2.

The manual supply path R3 is partially formed by the duplexing unit 12 as a unit body. The duplexing unit 12 also forms the reverse transport path R2. Hereinafter, the duplexing unit 12 will be described in further detail.

The duplexing unit 12 is formed to be detachable with respect to the apparatus main body 1A including the recording unit 2 and the scanner unit 3. Therefore, it is possible to easily remove the sheet when sheet is jammed in the duplexing unit 12. The duplexing unit 12 as shown in FIGS. 6 and 7 is provided on the rear surface side of the apparatus main body 1A, and configures the rear surface of the apparatus main body 1A in a mounted state.

A locking release knob 14 is provided on both sides of the upper portion of a rear surface plate 15 that configures the rear surface of the duplexing unit 12. By the two locking release knobs 14 being slid in a direction approaching one another, locking by a locking mechanism not shown in the drawings, that is a mechanism that locks the duplexing unit 12 to the apparatus main body 1A, is released, and it is possible to remove the duplexing unit 12 as shown in FIG. 7.

Reference sign 2*a* in FIG. 7 indicates a mounting region at which the duplexing unit 12 is mounted to the apparatus main body 1A. The above-described guide member 33 is exposed by removing the duplexing unit 12. That is, downstream side of the sheet transport path is exposed by the intermediate roller 24. Since the guide member 33 configures the all three of the above-described sheet transport paths, the part of the transport path common to the three sheet transport paths described above is exposed by removing the duplexing unit 12.

The duplexing unit 12 is configured to include the above-described manual cover 6, the intermediate roller 24, the driven rollers 25A to 25D, the manual guide portion 7, the rear surface plate 15 and the paper supports 13*a* and 13*b*. The paper supports 13*a* and 13*b* are housed on the inner side of the rear surface plate 15, and are able to be drawn out in the vertical direction. The paper support 13*b* is housed inside the paper support 13*a*, and is able to be drawn out in the vertical direction. The paper support 13*a* takes the inclined posture as shown in FIG. 2 in the drawn out state, and supports the manually supplied sheet P.

The optical sensor 21 (FIGS. 3 to 5) detects a sheet in a position to the upstream side in the feeding direction with respect to the roller pair, that is, the reversing roller 24 and the driven roller 25B, positioned furthest to the upstream side on the manual supply path R3 where a sheet is supplied via the manual guide portion 7.

In so doing, the operation effects as below are obtained. That is, a thin, flexible sheet does not pass through the nipping position due to the roller pair, and, as a result, there is concern of the sheet not being supplied. However, since the optical sensor 21 detects a sheet in a position to the upstream side in the feeding direction of the sheet with respect to the roller pair positioned furthest to the upstream side on the manual supply path R3 where the sheet is supplied via the manual guide portion 7, and is able to reliably detect the sheet even in a case in which a thin, flexible sheet is supplied.

If the reversing roller 24 is driven based on the sheet detection, since the sheet is reliably fed to the downstream side, it is possible to reliably supply even a thin, flexible sheet.

When the optical sensor 21 detects a sheet on the manual supply path R3, the controller (not shown) of the printer 1 is able to notify the user of the apparatus side detecting the sheet using light, sound or another user interface (printer driver that operates in the computer or display panel provided on the operation panel 5). In so doing, it is possible to contribute to a level of comfort of inserting the sheet without problems with respect to the user.

For example, in a case in which insertion of the sheet from the manual supply path R3 is not appropriate, for example, in a case in which the sheet is inserted via the manual supply path R3 and the sheet is detected by the optical sensor 21 during the execution of recording (where the rear edge of the sheet completely passes through the optical sensor 21 during the execution of recording), the controller of the printer 1 is able to suspend the sheet transport operation. In so doing, it is possible to prevent the inserted sheet from being supplied in the transport path via rotation of the intermediate roller 24.

In this case, in addition to suspending the sheet transport operation, it is possible to use the above-described user interface and present an error message or a message urging removal of the inserted sheet to the user.

Next, the sheet width able to pass through the duplexing unit 12 will be described. In the present embodiment, although the maximum size of a sheet able to be accommodated in the sheet cassette 40 and the sheet cassette 45 is, strictly speaking, letter size (215.9 mm×279.4 mm), below, for the sake of convenience, description will be made with A4 size (210 mm×297 mm) as the maximum size of a sheet able to be accommodated in each cassette.

Paper is set in the sheet cassettes 40 and 45 with the long direction of an A4 size sheet set as the feeding direction (A4 portrait transport). That is, the maximum sheet width (x direction width) able to be fed by the sheet feed path R1 is the size of the A4 short side.

Meanwhile, the manual supply path R3 has a larger width than the size of the A4 short side (A4 portrait transport) that is the maximum width (maximum width in the x direction) able to be fed to the sheet feed path R1, and the size of the A4 long side (the same as the size of the A3 short side) is the maximum width able to be fed. The maximum width able to be transported again to the region opposing the recording head 30 through the reverse transport path R2 is smaller than the manual supply path R3, specifically, is set to the size of the A4 short side that is the same as the sheet feed path R1. That is, the width (width in x direction) of the reverse transport path R2 as a second transport path is smaller than the width of the manual supply path R3 as a first transport path.

More specifically, from each cassette on the sheet feed path R1 to the merging position (generally top portion of the intermediate roller 24 in FIGS. 3 to 5: indicated by the reference sign K) of the sheet feed path R1 and the manual supply path R3, the width of the path is formed matching the A4 short side. Since the reverse transport path R2 is the same as the sheet feed path R1 from the position of the driven roller 25A to the merging position K (using a portion of the sheet feed path R1), the maximum sheet width able to pass through the reverse transport path R2 is the size of the A4 short side. In contrast, path width downstream from the merging position K is formed matching the size of the A4 long side. For the manual supply path R3, the path width upstream from the merging position K is also formed matching the size of the A4 long side.

Reference sign 12*a* in FIG. 8 indicates the sheet introduction port (sheet introduction port of the sheet feed path R1 and the reverse transport path R2) in the duplexing unit 12, and the dimension A represents the size of the A4 short side. Reference sign 12*b* indicates the sheet discharge port (shared by the sheet feed path R1, reverse transport path R2, and manual supply path R3) in the duplexing unit 12, and the dimension B indicates the size of the A4 long side (the same as the size of the A3 short side). The white arrow in FIG. 8 indicates the introduction direction of a sheet introduced to the sheet introduction port 12*a*, and the black arrow indicates the discharge direction of the sheet discharged from the sheet discharge port 12*b*.

As above, in the printer 1 according to the embodiment, since the width of the reverse transport path R2 (width in the x direction) is smaller than the width of the manual supply path R3 (width in the x direction), in a case in which the sheet on which recording is performed swells by absorbing ink and warps in the width direction, the extent of the warping is reduced. As a result, it is possible to prevent the occurrence of paper jams in the reverse transport path R2 or possible to reduce the frequency thereof.

In addition, since a case of passing through the reverse transport path R2 becomes A4 portrait transport, it is possible to suppress skewing compared to A4 landscape transport. In addition, for the region of the rear edge side of the sheet, since time is necessary to again reach the region opposing the recording head 30 compared to A4 landscape transport, it is possible to promote drying of the ink.

In the embodiment, since the region occupied by the recording head 30 and the carriage 29 configuring the recording portion, and the region occupied by the reverse transport path R2 at least partially overlap with each other in the height direction of the apparatus, it is possible to suppress the dimension in the height direction of the apparatus. In particular, in the embodiment, since the reverse transport path R2 is nearly completely accommodated in the region occupied by the recording head 30 and the carriage 29 in the height direction of the apparatus, it is possible to more effectively suppress the dimension in the height direction of the apparatus.

In the embodiment, for the sheet feed path R1 and the manual supply path R3, the feeding reference position in the sheet width direction (x direction) is set to the center. Accordingly, it is possible to suppress skewing of the sheet along the path.

In the embodiment, since at least a portion of the reverse transport path R2 is formed by the duplexing unit 12 that is detachable with respect to the apparatus main body 1A, at least a portion of the reverse transport path R2 is exposed (FIG. 7) by removing the duplexing unit 12, and, in so doing, it is possible to easily remove a jammed sheet when a paper jam occurs.

Similarly, in the embodiment, since at least a portion of the manual supply path R3 is formed by the duplexing unit 12, at least a portion of not only the reverse transport path R2 but also the manual supply path R3 is exposed (FIG. 7) by removing the duplexing unit 12, and, in so doing, it is possible to easily remove a jammed sheet when a paper jam occurs.

Figure 9A:
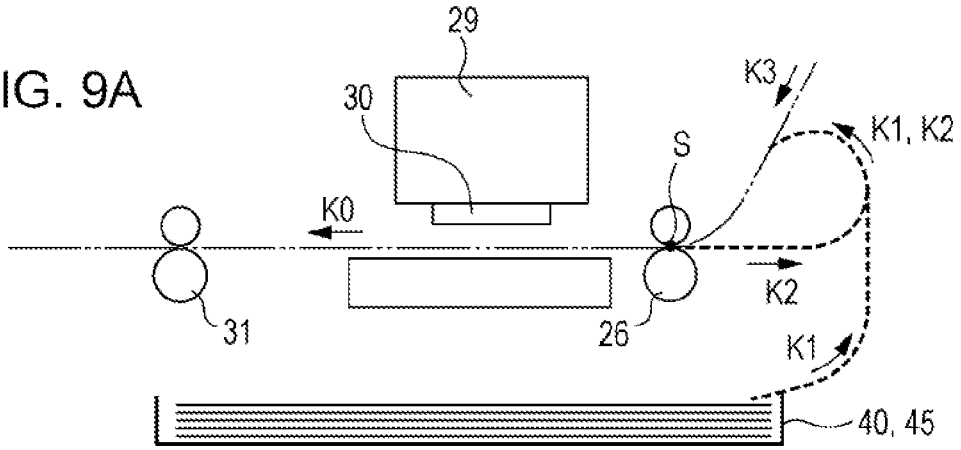
FIGS. 9A to 9C are drawings each showing a variation of the sheet feed path and the reverse transport path.

FIG. 9A schematically shows the sheet path of the printer 1 according to the above-described embodiment. Arrow K0 indicates the shared feeding direction shared by all of the sheet transport paths that is the sheet feeding direction when recording is executed, the arrow K1 indicates the feeding direction of a sheet fed from the sheet cassettes 40 and 45, arrow K2 indicates the feeding direction of a sheet transported via the reverse transport path R2, and arrow K3 indicates the feeding direction of a sheet supplied via the manual supply path R3. The thick broken line indicates a segment in which the path width is the size of the A4 short side, and the double dotted and dashed line indicates a segment in which the path width is the size of the A4 long side (size of the A3 short side).

In the embodiment, the branching portion S (entry to reverse transport path R2) at which the manual supply path R3 branches to form the reverse transport path R2 as is clear from FIG. 9A is positioned to the upstream side (right side in the drawing) in the transport direction during execution of recording with respect to the recording head 30.

Figure 9B:
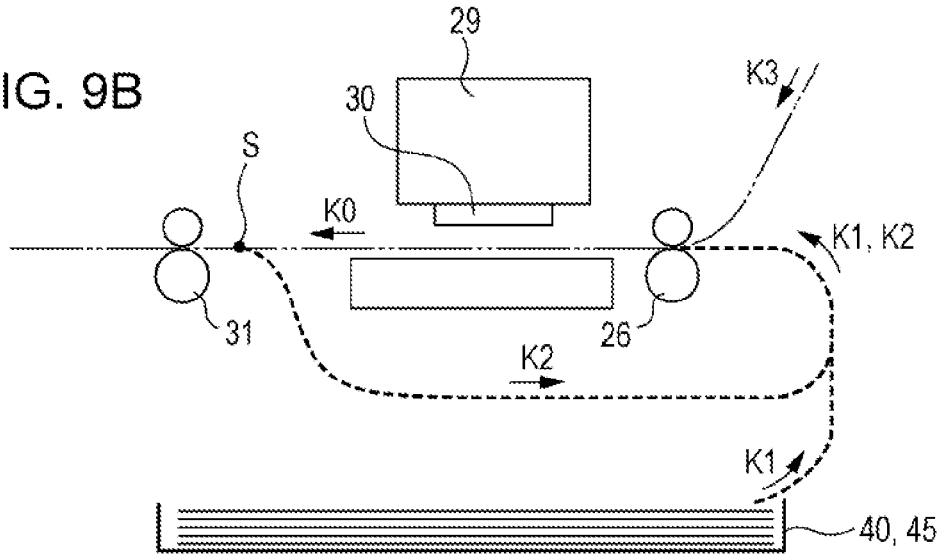

FIG. 9B shows an example in which the branching portions (entry of the reverse transport path R2) is positioned to the downstream side (left side in the drawing) in the transport direction during execution of recording with respect to the recording head 30.

Figure 9C:
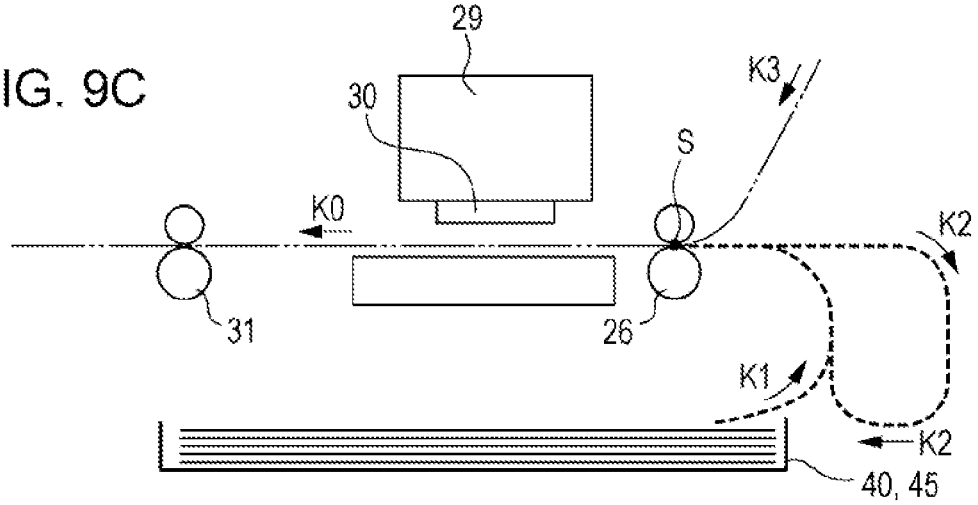

FIG. 9C shows an example in which the branching portion S (entry to reverse transport path R2) is positioned to the upstream side (right side in the drawing) in the transport direction during execution of recording with respect to the recording head 30, and the region occupied by the reverse transport path R2 in the height direction of the apparatus and the region occupied by the recording head 30 and the carriage 29 do not overlap.

The thick broken line, the double dotted and dashed line, and arrows K0, K1, and K2 in FIGS. 9B and 9C have the same meanings as indicated in FIG. 9A.

Figure 10A:
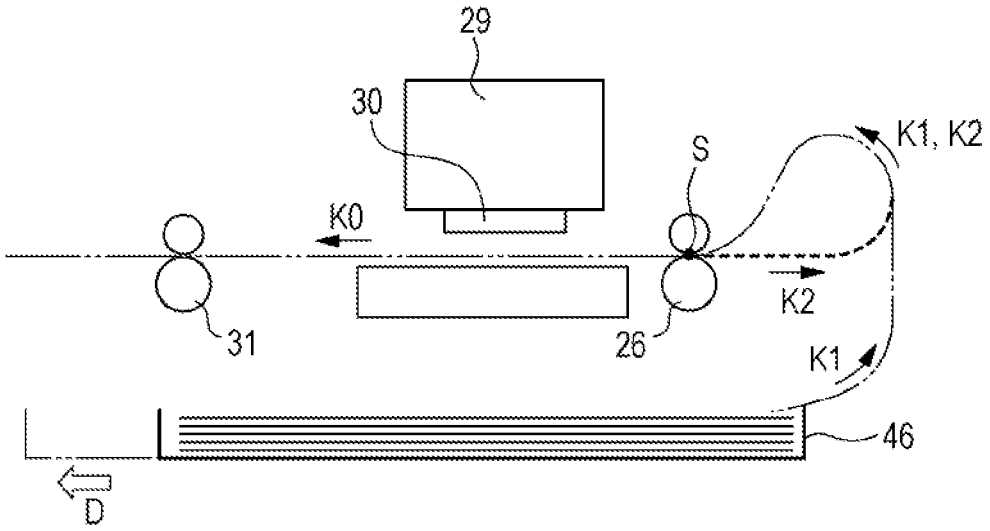
FIGS. 10A and 10B are drawings each showing a variation of the sheet feed path and the reverse transport path.

FIG. 10A shows the transport path (arrow K1) when the "first transport path" transports a sheet from the tray 46. The sheet accommodating region of the tray 46 is also able to be extended in the sheet width direction (x direction) and able to be extended in the sheet feeding direction, as indicated by arrow D. For example, before extending, an A4 size sheet is able to be accommodated in portrait orientation at maximum, and after extension, an A3 size sheet is able to be accommodated in portrait orientation at maximum (or an A4 size sheet in landscape orientation may be accommodated). The sheet fed from the tray 46 is fed in A4 portrait orientation or in A4 landscape orientation in the case of A4 size, and in A3 portrait orientation in the case of A3 size. In this configuration, the width of the transport path used when transporting a sheet from the tray 46 as the "first transport path" is configured to be smaller than the width of the reverse transport path R2. Accordingly, in a case in which an A4 size sheet is provided in landscape orientation or a case in which an A3 size sheet is supplied, the sheet is not fed to the reverse transport path R2.

Figure 10B:
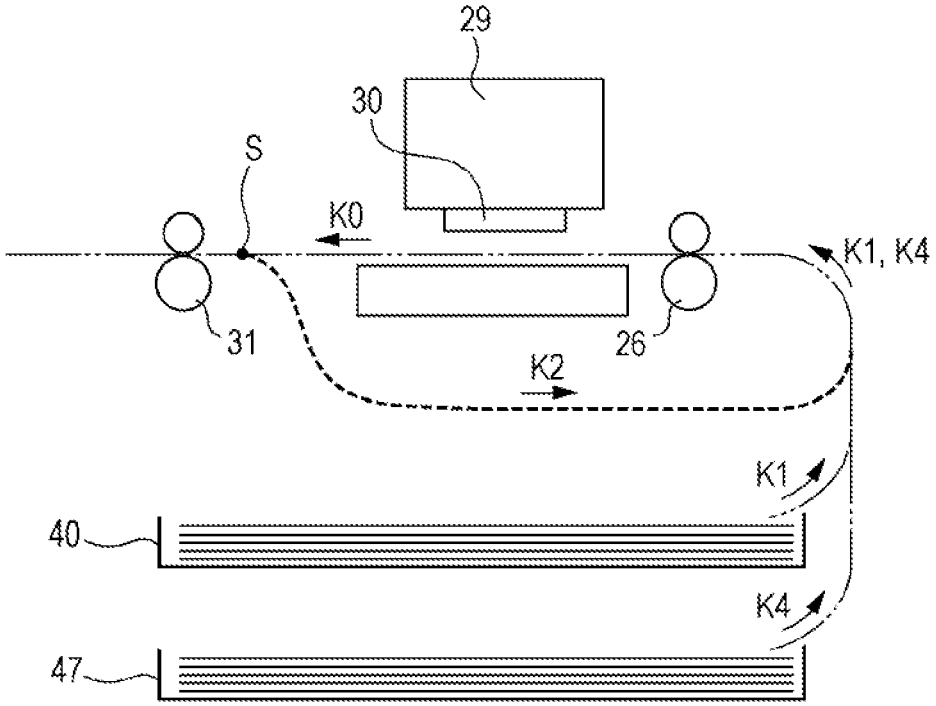

FIG. 10B shows an example in which a tray 47 is included that is able to accommodate an A3 size sheet in portrait orientation at maximum, in addition to a tray 40 that is able to accommodate an A4 size sheet in portrait orientation or in landscape orientation at maximum. In this configuration, each sheet fed from both of the trays 40 and 47 transits the shared transport path (arrows K1 and K4). In this configuration, the "first transport path" is a transport path used when transporting a sheet from the trays 40 and 46 (arrows K1 and K4). That is, the width of the transport path used when transporting a sheet from the trays 40 and 47 is configured to be smaller than the width of the reverse transport path R2. Accordingly, in a case in which an A4 size sheet is provided in landscape orientation or a case in which an A3 size sheet is supplied, the sheet is not fed to the reverse transport path R2.

In the cases shown in each of the above embodiments, the maximum width of the reverse transport path R2 is set to be smaller than the maximum width of the other supply paths. Accordingly, in a case in which a sheet on which recording is performed warps in the width direction, the extent of the warping is restricted to a predetermined range. As a result, it is possible to prevent the occurrence of paper jams in the reverse transport path R2 or possible to reduce the frequency thereof.

The above-described embodiments are examples, and various other modifications are possible. For example, each embodiment (combination of sheet transport paths) shown in FIGS. 9A to 10B are an example, and it is possible to obtain, as appropriate, combinations of other transport paths, that is other combinations of the first transport path and the second transport path.

Embodiment 2

Hereinafter, the liquid ejecting apparatus of Embodiment 2 that is an example of the recording apparatus will be described with reference to the drawings. The liquid ejecting apparatus of the embodiment includes a recording portion that records by printing images or the like that include text or figures by ejecting a liquid on a sheet as an example of a fed medium formed in a sheet shape, and discharges the recorded sheet from the recording portion.

As shown in FIGS. 11, 12, 19A, and 19B, a liquid ejecting apparatus 111 of the present embodiment includes, inside an apparatus main body 112, a recording portion 120 that records images or the like by ejecting ink as an example of a liquid with respect to the sheet P and includes a housing formed in a substantially parallelepiped shape that is configured of a plurality of members, as the apparatus main body 112. A sheet cassette 130 that is an example of a second feeding portion having a mounting stand on which sheets P are able to be mounted in a stacked state is further included with respect to the apparatus main body 112 to be insertable and extractable.

An operation panel 113 including a display portion 113*a* (for example, a liquid crystal display) that displays a menu screen or the like for operating the recording portion 120, an operation portion 113*b* (for example, operation buttons), or the like is arranged on the front surface side of the apparatus main body 112 that becomes the discharge direction side of the sheet P discharged from the recording portion 120 after recording. An image reading portion 115 such as a scanner with an image reading surface that is openable/closable by a cover member 115*a* is arranged on the upper surface side that is the antigravity direction Z side of the apparatus main body 112.

The sheet cassette 130 is arranged below the operation panel 113 to be insertable and extractable from the front side in a direction that is the same as the discharge direction side of the sheet PA with respect to the apparatus main body 112, and a sheet P mounted on the mounting stand 132 is fed and transported to the sheet transport path provided on the inner side in the insertion direction (rear side), and supplied to the recording portion 20.

Figure 19A:
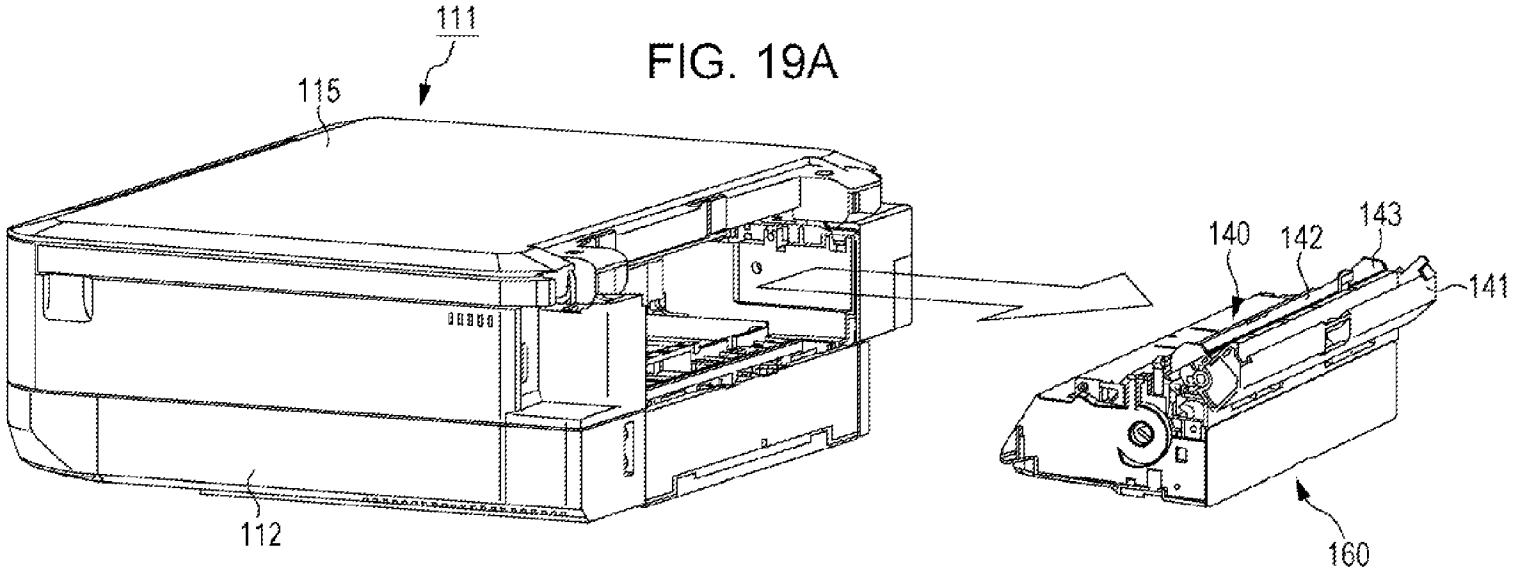
FIGS. 19A and 19B are state explanatory diagrams showing a state in which the reversing unit is removed from the apparatus main body.

As shown in FIG. 19A, in the liquid ejecting apparatus 111, a reversing unit 160 as a removable member that is disconnected and removed from the apparatus main body 112 by being removed rearward with respect to the apparatus main body 112 is included on the rear side opposite the operation panel 113. The reversing unit 160 is a unit in which the front and rear of the sheet P are reversed, in other words, the target recording surface is reversed by transporting a sheet PA in the feed path (transport path) in a case of performing recording on both surfaces of the sheet PA, and has a plurality of transport paths that form the feed path of the sheet P supplied to the recording portion 120.

Figure 11:
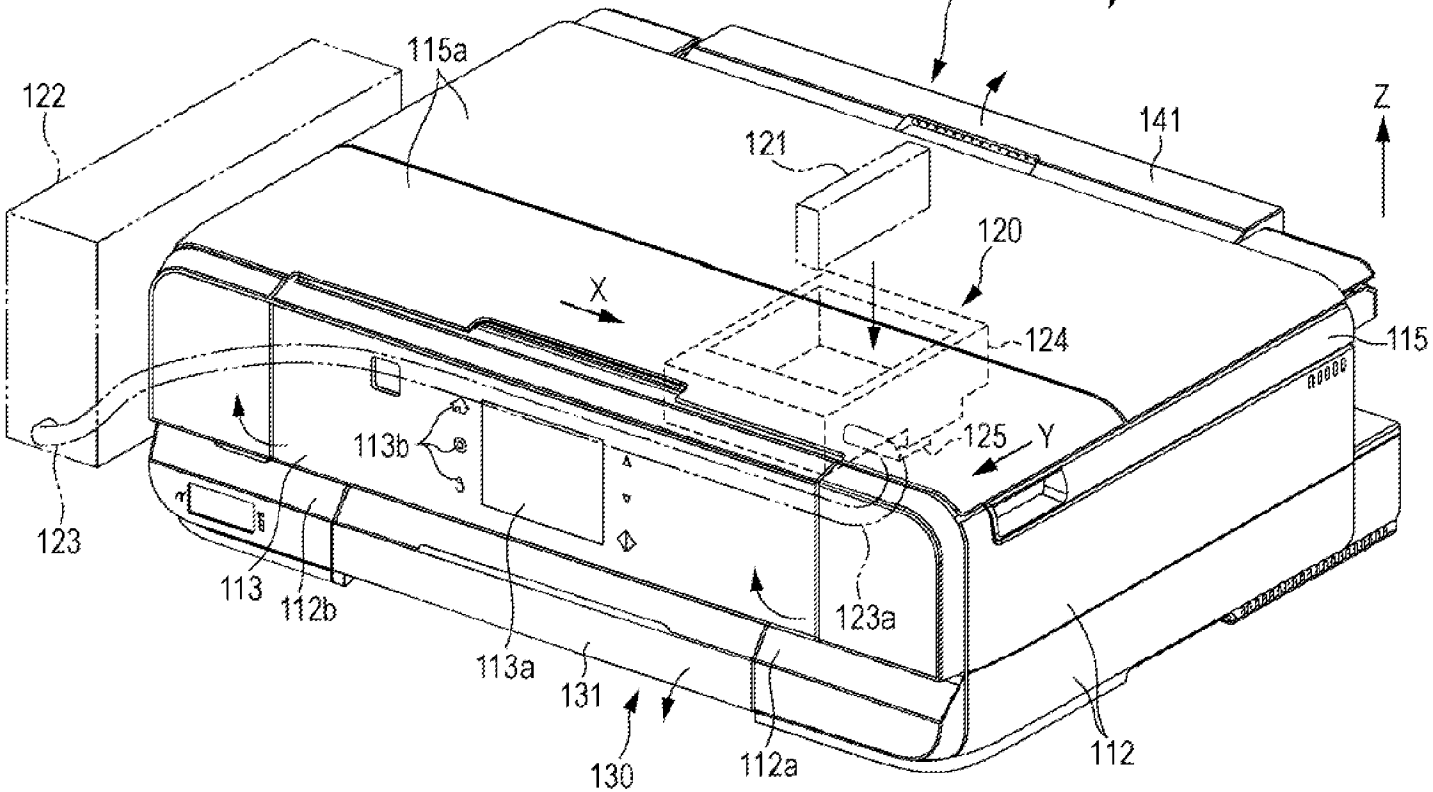
FIG. 11 is a perspective view showing a liquid ejecting apparatus as one embodiment of the recording apparatus.
Figure 12:
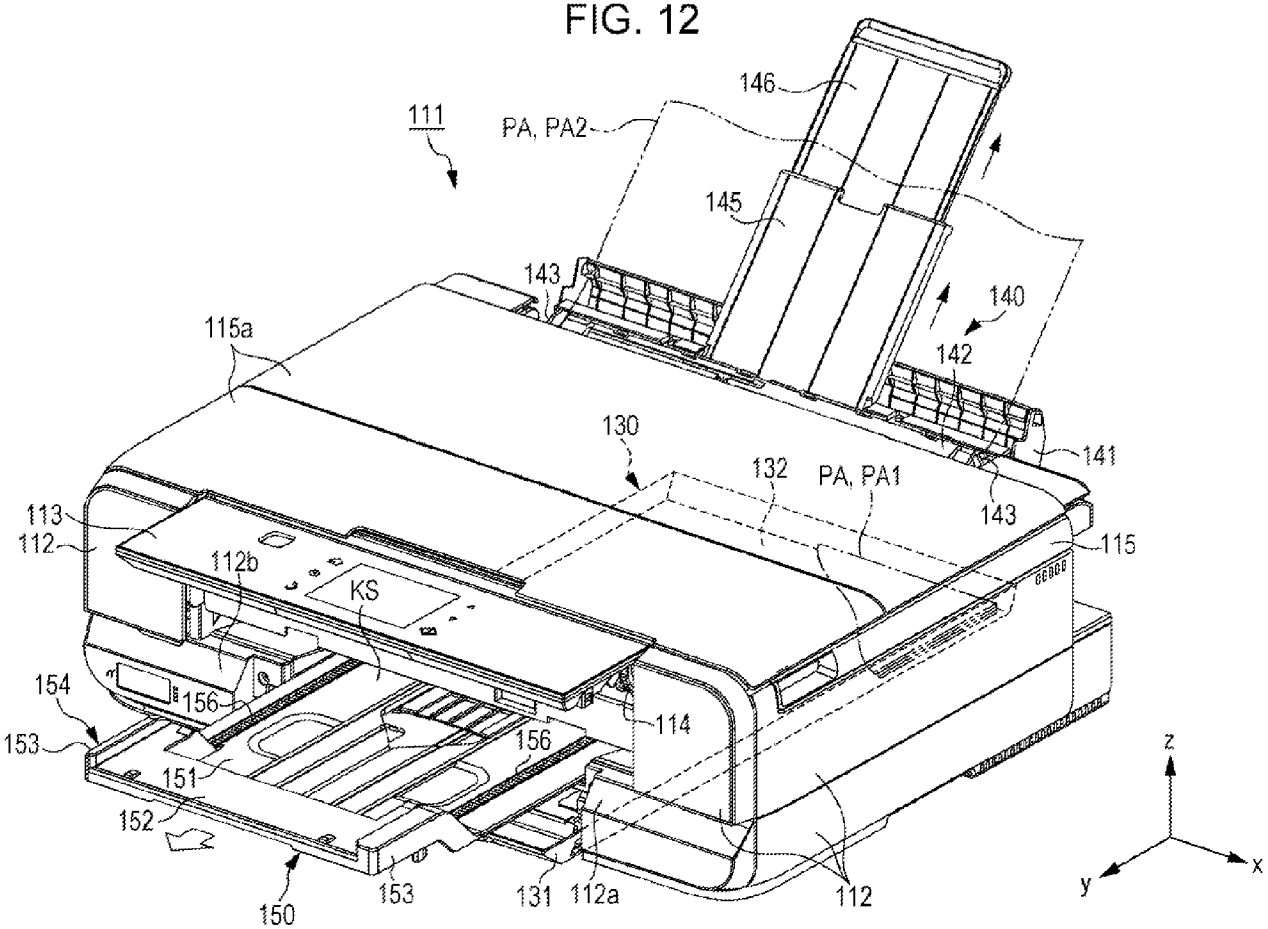
FIG. 12 is a perspective view showing a printing state in which printing is performed on a sheet in a liquid ejecting apparatus.

As shown in FIGS. 11 and 12, in the liquid ejecting apparatus 111, a manual feeding portion 140 that is an example of a first feeding portion that feeds sheets PA to be manually inserted one at a time to the recording portion 120 is further included at an upper location on the rear side of the opposite side to the front side on which the operation panel 113 is provided in the apparatus main body 112, in addition to feeding the sheet PA from the sheet cassette 130. That is, in contrast to the sheet cassette 130 being provided on the discharge direction side of the discharged sheet P in the apparatus main body 112, the manual feeding portion 140 is provided in the reversing unit 160 on the opposite direction side to the discharge direction of the sheet P in the apparatus main body 112. In the embodiment, the sheet PA fed from the sheet cassette 130 from the sheets PA is referred to as sheet PA1, as necessary, and the sheet PA fed from the manual feeding portion 140 is distinguished by being referred to as a sheet PA2.

The manual feeding portion 140 includes an insertion port 142 in which the sheet P is able to be inserted on the apparatus main body 112, and an opening/closing lid 141 that covers the insertion port 142 is included to freely swing on the apparatus main body 112. The opening/closing lid 141, as shown in FIG. 1, in the case of not performing the supply of the sheet PA by the manual feeding portion 140, is set to a closed state so that foreign material such as dust does not enter the insertion port 142. Meanwhile, as shown in FIG. 12, in a case of feeding a sheet PA to the recording portion 120 by the manual feeding portion 140, the opening/closing lid 141 enters into an open state by swinging, and the sheet P is inserted into the exposed insertion port 142 and fed to the recording portion 120.

In the embodiment, a support plate 145 able to be drawn out from the apparatus main body 112 and a support plate 146 able to be drawn out from the support plate 145, having a so-called two-stage drawing out structure are included in the manual feeding portion 140. As shown in FIG. 12, by withdrawing each of the support plates 145 and 146 as necessary, it is possible to support the fed sheet P from the lower side that is the gravity direction side. The size of insertion port 142 in the width direction that intersects the feed direction of the sheet PA is adjustable by two movable members 143 provided to be slidable in the width direction. In other words, it is possible to adjust the width dimension of the insertion port 142 to suit the width dimension of the inserted sheet PA2 by adjusting the gap between the two movable members 143.

Figure 19B:
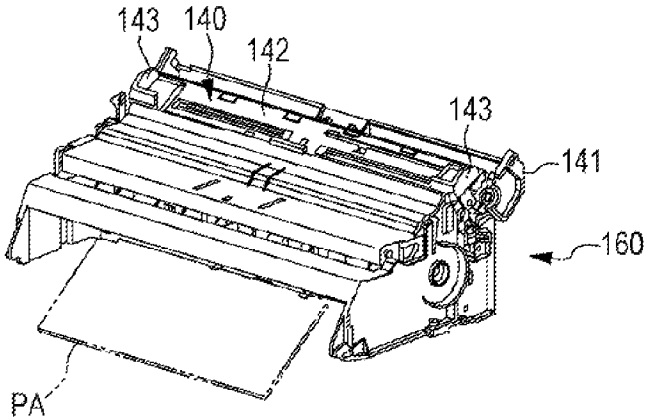

In a case of a sheet entering into a jammed state in the feed path of the sheet PA formed in the reversing unit 160, a jam process is performed by removing the reversing unit 160 from the apparatus main body 112. For example, since the sheet P in a jammed state in the feed path, as shown in FIG. 19B, is exposed in a state in which the reversing unit 160 is removed from the apparatus main body, a user can perform the jam process while observing the sheet PA in the jammed state.

In the liquid ejecting apparatus 111, recording is performed with respect to the sheet PA fed to the recording portion 120 from the sheet cassette 130 and the manual feeding portion 140. That is, as shown in FIG. 11, a guide frame, not shown, that extends along the width direction (referred to as the main scanning direction X) that intersects the feeding direction of the fed sheet PA is positioned at the position corresponding to the recording portion 120 in the apparatus main body 112. A carriage 124 that is an example of a moving body is supported in a movable state along the main scanning direction X on the guide frame. The carriage 124 is moved to reciprocate along the main scanning direction X according to driving of a carriage motor, not shown.

A liquid ejecting head 125 that ejects ink is supported on the lower surface side of the carriage 124. The liquid ejecting head 125 moves according to the movement of the carriage 124 and ink is ejected with respect to the sheet PA from the moving liquid ejecting head 125. Meanwhile, the sheet PA is moved (intermittent movement) in the transport direction that intersects the main scanning direction X (referred to as sub-scanning direction Y) according to the driving of a paper feeding motor, not shown, with respect to the liquid ejecting head 125. In the recording portion 120, recording (printing) on the sheet PA is performed in the recording portion 120 by both movement in the main scanning direction X of the carriage 124 and movement in the sub-scanning direction Y of the sheet PA.

In the present embodiment, during recording of the recording portion 120, an ink cartridge 121 as a plurality of liquid accommodating bodies that accommodate ink is mounted on a mounting portion provided on the carriage 124 inside the apparatus main body 112, and supplies ink to the liquid ejecting head 125. Although FIG. 11 shows a state in which only one ink cartridge 121 is mounted on the carriage 124, normally a plurality of ink cartridges is mounted on the carriage 124.

Alternatively, as shown by the double dotted and dashed line in FIG. 11, ink may be supplied with respect to the liquid ejecting head 125 from the liquid accommodating body in which ink can be accommodated in greater quantities than in the ink cartridge 121. That is, a configuration may be used in which an ink tank 122 as an example of a liquid accommodating body formed as a separate body from the apparatus main body 112 is provided outside the apparatus main body 112, and at least a portion of the ink is supplied to the liquid ejecting head 125 from the ink tank 122 via a liquid supply tube 123 in which ink is able to flow.

The liquid supply tube 123 that supplies the ink from the ink tank 122 is able to supply ink to the liquid ejecting head 125 by being routed to the inside of the apparatus main body 112 from outside the apparatus main body 112 through a gap, through hole or notch portion, all not shown, formed in the apparatus main body 112. That is, the liquid supply tube 123 guides the ink fed from the ink tank 122, in which the ink is accommodated, to the recording portion 120, and is arranged having a deforming movable portion 123*a* that is deformed so as to follow the movement of the carriage 124.

The operation panel 113 is attached to be able to swing with respect to the apparatus main body 112 in a state in which the lower side of the operation panel 113 is able to be raised forward through the rotation mechanism 114 provided on the upper side of the operation panel 113, as shown by the arrow in FIG. 11. Accordingly, the operation panel 113 functions as a displacement member. Meanwhile, the front panel 131 that is an example of the displacement member is attached to the front surface of the sheet cassette 130. The front panel 131 is attached to be able to swing with respect to the apparatus main body 112 by a hinge structure, not shown, provided on the lower side thereof, in a state in which the upper side is drawn out forward as shown by the arrow in FIG. 1. Accordingly, the front panel 131 functions as a displacement member.

In the embodiment, the operation panel 113 and the front panel 131 are able to swing manually by a user, and function as a portion of the housing member that configures the apparatus main body 112 of the liquid ejecting apparatus 111. The operation panel 113 may have a configuration that swings automatically, by being driven to rotate by a gear, not shown, that meshes with the rotation mechanism 114 driven by a driving source, not shown.

As shown in FIG. 11, in the embodiment, the length of the operation panel 113 is longer than the length of the front panel 131, in the width direction along the main scanning direction X of the apparatus main body 112.

Therefore, on both sides of the front panel 131 in the width direction, the apparatus main body locations 112*a* and 112*b* that configure a portion of the housing part are provided as a housing part that is continuous in external appearance with the front panel 131, so that the gap or opening in the front panel 131 and the housing part of apparatus main body 112 is continuous without being exposed.

On the inner side (rear side) of the operation panel 113 and the front panel 131, a storage space in which the medium receiving portion 150 having a substantially rectangular receiving surface 151 that receives the sheet PA discharged from the recording portion 120 is provided inside the apparatus main body 112. For the storage space, the housing opening portion KS that corresponds to the front surface part of the storage space is exposed by opening both of the operation panel 113 and the front panel 131 of the sheet cassette 130. In other words, the displacement member of the operation panel 113 and the front panel 131 is provided to be able to displace between the closed position in which the housing opening portion KS is not exposed and the opened position in which the housing opening portion KS is exposed.

The medium receiving portion 150 is configured to be drawn out in a forward direction which is the discharge direction of the sheet P from the apparatus main body 112 via the housing opening portion KS, in a state in which the housing opening portion KS is exposed, that is, in a state in which both of the operation panel 113 and the front panel 131 are closed. The upper surface on the antigravity direction side of the medium receiving portion 150 is used as a receiving surface 151 that receives the discharged sheet P, and the receiving surface 151 is positioned at the opening part at which the front panel 131 is opened and exposed from among the housing opening portions KS. Therefore, as shown in FIG. 12, the position (height) of the receiving surface 151 in the antigravity direction Z is made lower than the upper edge position (height) of the apparatus main body locations 112*a* and 112*b* provided on both sides of the front panel 131 in the width direction.

The medium receiving portion 150 is formed to be a protrusion portion 154 in which lateral side edge portions 153 on both sides in the width direction on the front side edge part 152 are raised further upward than another part, and, in the receiving surface 151 that receives the discharged sheet PA, the front side edge part 152 that is the side of the drawing out direction (sub-scanning direction Y side) is raised further upward than another part. In the protrusion portion 154, a concavity 155 (refer to FIG. 13) is formed on the lower surface side of the front side edge part 152, and the protrusion portion 154 (front side edge part 152) has a shape that is easily gripped when a user draws out the medium receiving portion 150.

Accordingly, in the embodiment, the medium receiving portion 150 is able to be drawn out from the apparatus main body 112 and pushed into the apparatus main body 112 along the discharge direction by manual operation of a user. For example, the medium receiving portion 150 may be configured to automatically be drawn out from the apparatus main body 112 by driving a pinion, not shown, that meshes with a rack 156 provided on the receiving surface 151 to rotate, or to be pushed into the apparatus main body 112 according to displacement between the open position and closed position of the operation panel 113 and the front panel 131.

The sheet PA discharged from the recording portion 120 passes through the housing opening portion KS in a state in which the medium receiving portion 150 is drawn out from the apparatus main body 112, and is discharged to the medium receiving portion 150 positioned outside the apparatus main body 112. Accordingly, the housing opening portion KS in a state in which the medium receiving portion 150 is drawn out functions as a medium discharge port through which the sheet PA is able to pass. In the embodiment, the upper surfaces of the apparatus main body locations 112*a* and 112*b* are configured to be positioned further upward than the receiving surface 151 of the medium receiving portion 150, and a portion of the housing opening portion KS is formed partitioned.

Although not shown, the medium receiving portion 150 includes a display portion that is an example of the medium holding portion on which an optical disc that is an example of a medium different from the sheet PA fed from the sheet cassette 130 and the manual feeding portion 140 is mounted (set) and held. In a case in which recording (ink jet recording) in the recording portion 120 is performed with respect to the optical disc on a label surface thereof, by the medium receiving portion 150 being moved to a storage position of the apparatus main body 112, it is possible for disk tray portion to be moved to a position at which the recording portion 120 (liquid ejecting head 125) is able to record with respect to the optical disc.

Next, the sheet PA discharged to the medium receiving portion 150 via the housing opening portion KS as a medium discharge port, and the feed path to which the sheet is supplied and transported from the sheet cassette 130 and the manual feeding portion 140 will be described with reference to the FIG. 13.

First, the feed path (transport path) of the sheet PA1 from the sheet cassette 130 will be described, and, thereafter, the feed path (transport path) of the sheet PA2 from the manual feeding portion 140 will be described. In the following description, the constituent elements described with reference to FIGS. 11 and 12 are given the same reference numerals, and description thereof will not be made.

Figure 13:
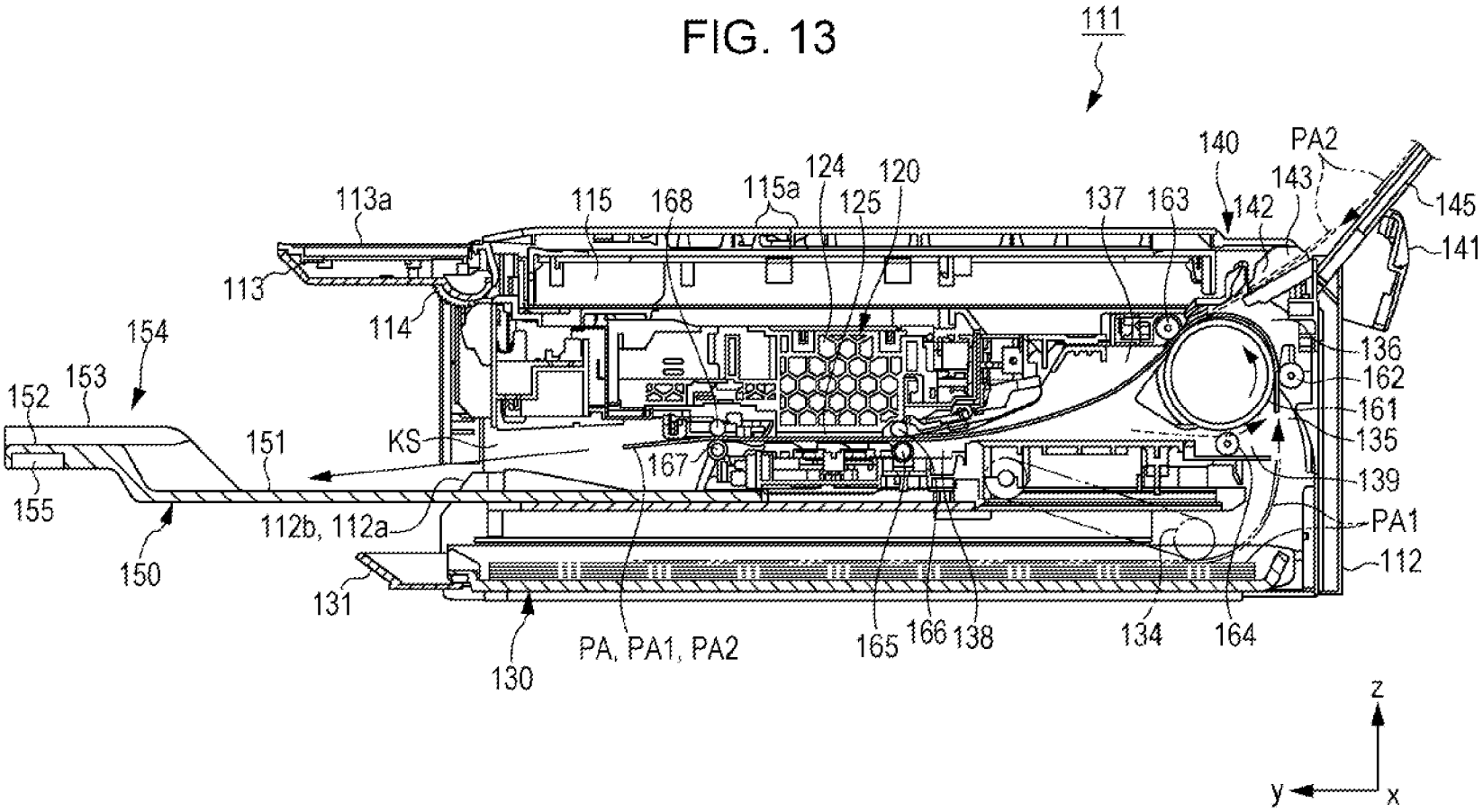
FIG. 13 is a cross-sectional view showing a movement path of the sheets fed from the sheet cassette and the manual feeding portion.

As shown in FIG. 13, in a case in which a sheet PA1 is fed from the sheet cassette 130, the sheet PA1 in the uppermost position from a plurality of sheets PA1 stacked on the mounting stand 132 of the sheet cassette 130 is fed one at a time to the transport path 135, as shown by the broken line in FIG. 13, by the paper feeding roller 134. In the embodiment, the sheet cassette 130 includes, in addition to the mounting stand 132 of the sheet PA1, at least one separate sheet cassette (not shown) including a mounting stand for a separate sheet thereabove. The sheet is similarly fed from the separate sheet cassette to the transport path 135 by the paper feeding roller 134. In the description below, in a case where it is not necessary to distinguish each sheet cassette, they are referred to as a "sheet cassette 130".

The sheet PA1 fed to the transport path 135 is pinched between the driving roller 161 that rotates in the arrow direction in FIG. 13 and the driven roller 162, and moves to the transport path 136 from the transport path 135. The sheet PA1 moved in the transport path 136 is pinched by the driving roller 161 and the driven roller 163, and is fed to the transport path 137 from the transport path 136.

Thereafter, the sheet PA1 is moved to the transport path 138 from the transport path 137, and is fed to the recording portion 120 by the leading edge in the transport direction being pinched between the roller pair of the feed rollers 165 and 166 in a state in which the pinched state is maintained by the roller pair of the driving roller 161 and the driven roller 163. From the sheet cassette 130, the sheet PA1 is fed continuously one at a time to the recording portion 120 by the paper feeding roller 134 and the driving roller 161 and the driven rollers 162 and 163, until entering into a state of being transported in a pinched manner by the feed rollers 165 and 166 as shown by the solid line in FIG. 13.

The sheet PA1 fed to the recording portion 120 is transported (intermittent movement) in the sub-scanning direction Y in the recording portion 120, and recording is performed with respect to the sheet PA1 by ejecting ink from the liquid ejecting head 125 that reciprocates in the main scanning direction X. The sheet PA1 on which recording is performed is discharged from the recording portion 120 by the leading edge in the transport direction being pinched by the roller pair of the discharge rollers 167 and 168, as shown by the arrow in FIG. 13.

Figure 14:
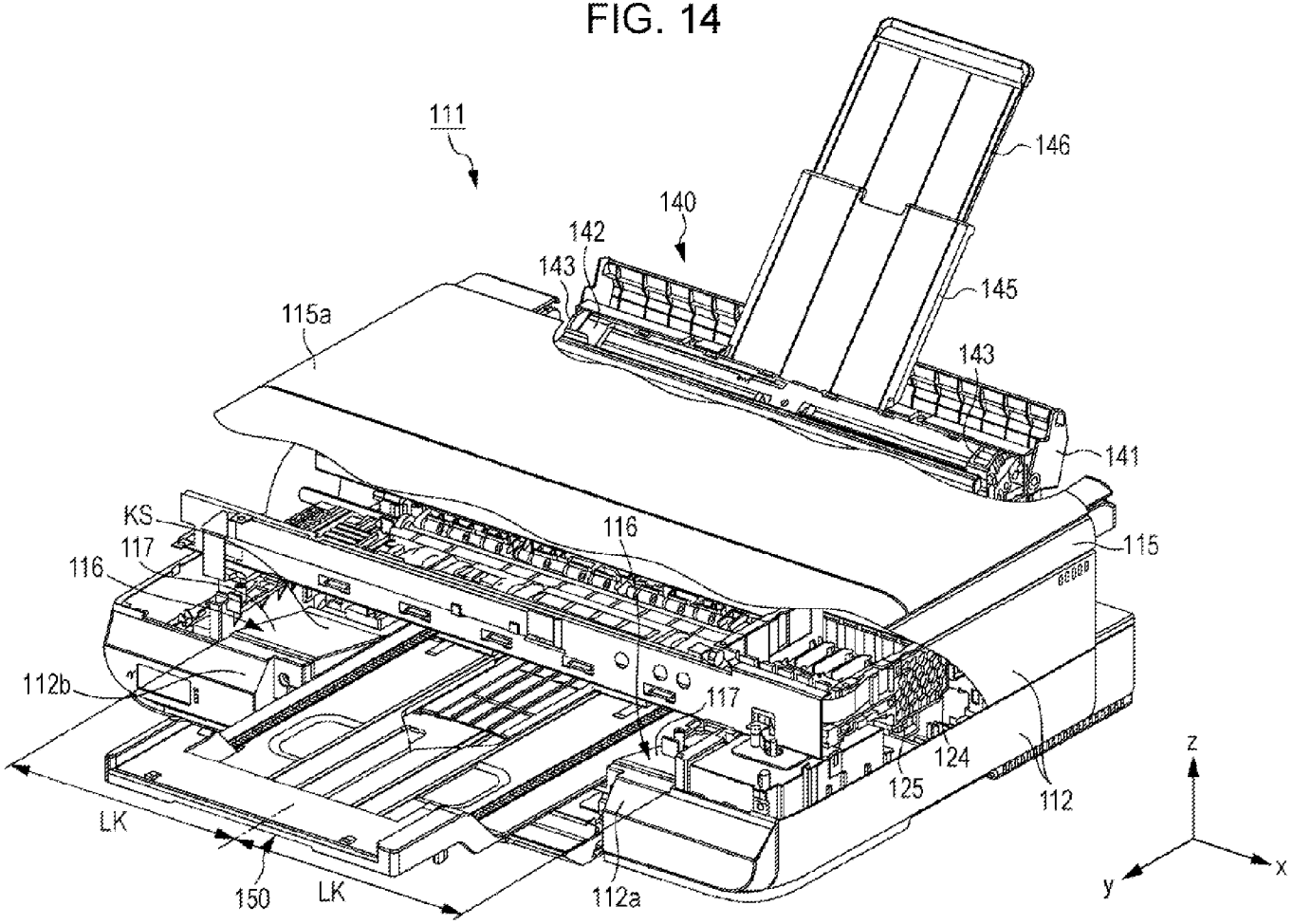
FIG. 14 is a perspective view in which a part of the housing is cut away for illustrating a medium discharge port included in the liquid ejecting apparatus.

Next, in a case of feeding the sheet PA2 by the manual feeding portion 140, the user opens the opening/closing lid 141, and inserts the leading edge of the sheet PA2 into the exposed insertion port 142 (refer to FIG. 14). Thereby, by the leading edge of the inserted sheet PA2 being moved in the gravity direction under its own weight, the sheet PA2 enters a part of a space region on the downstream side in the transport direction of the transport path 136 from the insertion port 142, as shown by the broken line in FIG. 13.

The insertion port 142 is formed in an inclined direction from the antigravity direction side toward the gravity direction side. Accordingly, the sheet PA2 inserted in the transport path 136 from the insertion port 142 moves smoothly in the transport path 136 by the leading edge portion thereof being inserted to be inclined with respect to the transport path 136, is pinched by the roller pair of the driving roller 161 and the driven roller 163, and is fed to the transport path 137.

Thereafter, the sheet PA2 is moved to the transport path 138 from the transport path 137, and is fed to the recording portion 120 by the leading edge in the transport direction being pinched between the roller pair of the feed rollers 165 and 166 in a state in which the pinched state is maintained by the roller pair of the driving roller 161 and the driven roller 163. Thereby, from the manual feeding portion 140, the sheet PA2 is fed one at a time to the recording portion 120 by the driving roller 161 and the driven roller 163, until entering into a state of being transported in a pinched manner by the feed rollers 165 and 166.

Similar to the sheet PA1, the sheet PA2 fed to the recording portion 120 is transported (intermittent movement) in the sub-scanning direction Y in the recording portion 120, and recording is performed by ejecting ink from the liquid ejecting head 125 that reciprocates in the main scanning direction X. The sheet PA2 on which recording is performed is discharged from the recording portion 120 similarly to the sheet PA1 by the leading edge in the transport direction being pinched by the roller pair of the discharge rollers 167 and 168, as shown by the solid line arrow in FIG. 13.

In the liquid ejecting apparatus 111 of the embodiment, recording is possible on both sides of the sheet PA. That is, the sheet PA on which recording is performed in the recording portion 120 on a single side (front surface) is transported in the opposite direction to the sub-scanning direction Y from the recording portion 120 by reversely rotating the roller pair of the discharge rollers 167 and 168. The sheet PA transported in the opposite direction of the transport path 138 is pinched by the roller pair of the driving roller 161 and the driven roller 164, and is fed to the transport path 139. The downstream side of the transport path 139 is linked to the transport path 135, and the sheet PA fed to the transport path 139 enters the transport path 135, and is subsequently fed again to the recording portion 120 similarly to the feeding of the sheet PA from the sheet cassette 130. At this time, the sheet PA that is fed again is fed in a state in which the front and rear are reversed. That is, at least the transport paths 135, 136, 137, and 139 are included in the reversing unit 160.

In the embodiment, among the sheets PA thus fed to the recording portion 120, the maximum dimension in the width direction (main scanning direction X) of the sheet PA2 that is able to be fed from the manual feeding portion 140 is made larger than the maximum dimension in the width direction (main scanning direction X) of the sheet PA1 that is able to be fed from the sheet cassette 130. That is, in the liquid ejecting apparatus 111, the sheet PA2 with a larger width dimension than the sheet PA1 able to be supplied from the sheet cassette 130 is able to be fed to the recording portion 120 by manual insertion one at a time from the manual feeding portion 140.

When the sheet PA1 and the sheet PA2 with a wider width dimension than the sheet PA1 is discharged from the recording portion 120, the sheets are discharged to the medium receiving portion 150 in a state of being drawn out from the storage space to outside the apparatus main body 112. Accordingly, in the embodiment, for the medium receiving portion 150, the dimension in the width direction that intersects the discharge direction of the discharged sheet PA is the maximum dimension in the width direction of the sheet PA1 that is able to be fed from the sheet cassette 130, and is set to a dimension smaller than the maximum dimension in the width direction of the sheet PA2 that is able to be fed from the manual feeding portion 140. Incidentally, in the embodiment, for the sheet PA1, A4 size is the maximum dimension able to be fed, and for the sheet PA2, A3 size which is larger than A4 is the maximum dimension that is able to be fed.

As shown in FIG. 14, in the liquid ejecting apparatus 111, the housing opening portion KS as a medium discharge port that the sheet PA discharged from the recording portion 120 passes through is provided with a larger width dimension than the medium receiving portion 150 through which the sheet PA2 is able to pass when discharged to the medium receiving portion 150 from the recording portion 120, in addition to the sheet PA1. That is, the housing opening portion KS has the same dimension LK on both sides with the medium receiving portion 150 as a center in the main scanning direction X that is the width direction that intersects the discharge direction of the sheet PA2 fed from the manual feeding portion 140, and is formed in a size of the maximum value of the width dimension of the sheet PA2 or more. In the housing opening portion KS, a medium support portion 116 that supports the sheet PA2 discharged from the recording portion 120 from the gravity direction (−Z) side on both sides in the width direction is provided on the apparatus main body 112.

In the embodiment, a medium support portion 116 is positioned on both sides of the medium receiving portion 150 in the width direction in the drawn out state, and the upper surface thereof is formed to have an inclined location 117 with an upward slope on which the sheet PA2 moved from the recording portion 120 toward the housing opening portion KS is gradually raised to the antigravity direction Z side from the height of the receiving surface 151. That is, the medium support portion 116 is formed so as to be positioned further upward than the upper edge portion of the apparatus main body locations 112*a* and 112*b* that are housing parts provided on both sides of the sheet cassette 130 (front panel 131) in the width direction by both end portions in the width direction of the sheet PA2 discharged from the recording portion 120 being moved along the inclined location 117.

In the embodiment, although the inclined location 117 is formed as one continuous surface, the inclined location may be at least a surface continuous along the discharge direction. Accordingly, the inclined locations 117, for example, may be a plurality of divided surfaces formed by a plurality of ribs being arranged to be extended along the discharge direction and having a gap in the width direction.

Figure 15:
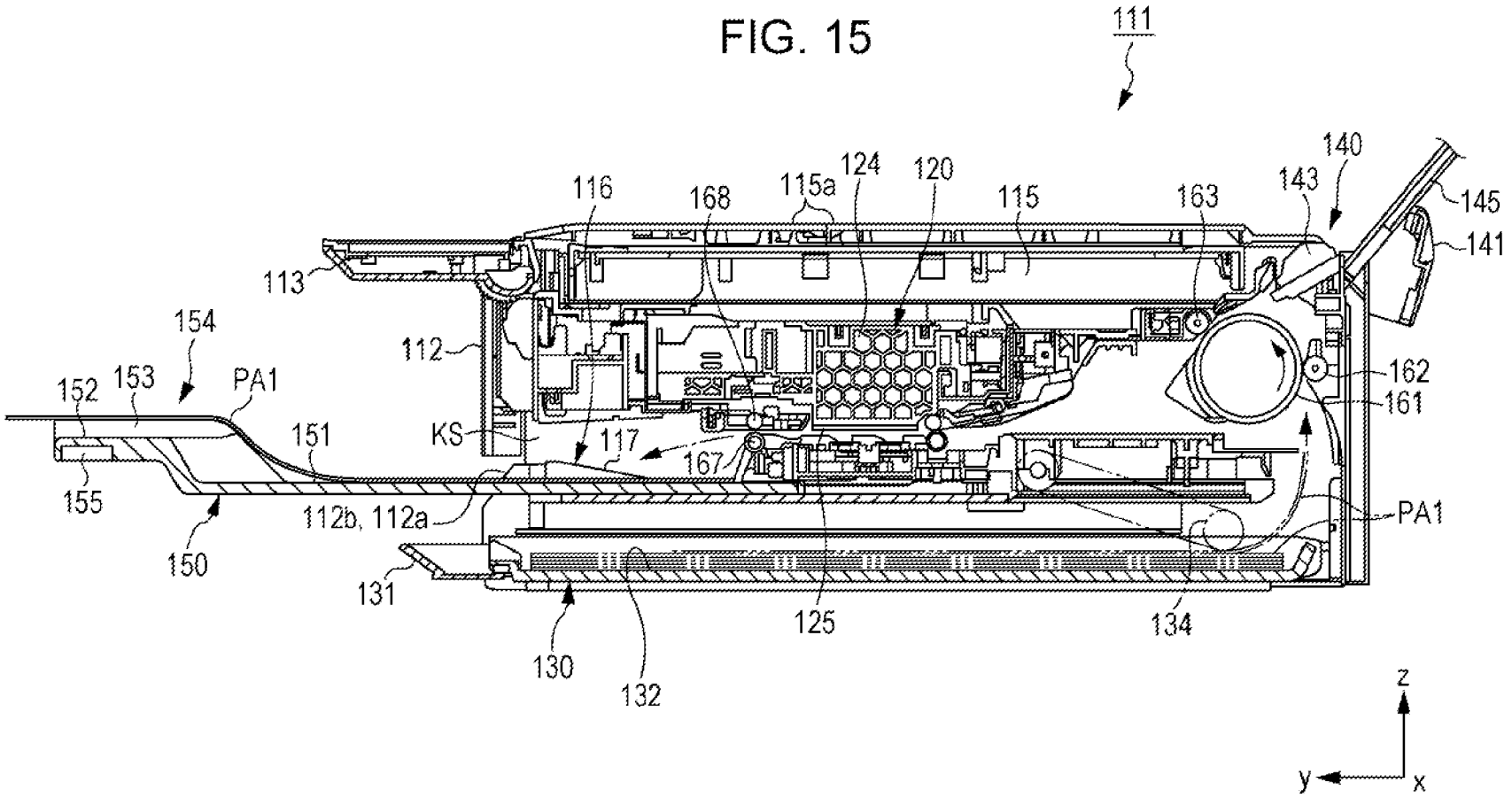
FIG. 15 is a cross-sectional view showing the discharge state of a sheet fed from the sheet cassette to the medium receiving portion.

Next, with reference to FIGS. 15 to 18, the actions in the liquid ejecting apparatus 111 of the embodiment, that is the discharge action to the medium receiving portion 150 of the sheet PA1 fed from the sheet cassette 130 (FIGS. 15 and 16) and the discharge action to the medium receiving portion 150 of the sheet PA2 fed from the manual feeding portion 140 (FIGS. 17 and 18) will be described. In FIGS. 15 and 17, the driven roller 164 for reversing the front and rear of the sheet PA is not shown. The embodiment may naturally be configured so that such a driven roller 164 is not provided, and to not include a function reversing the front and rear of the sheet P.

Figure 16:
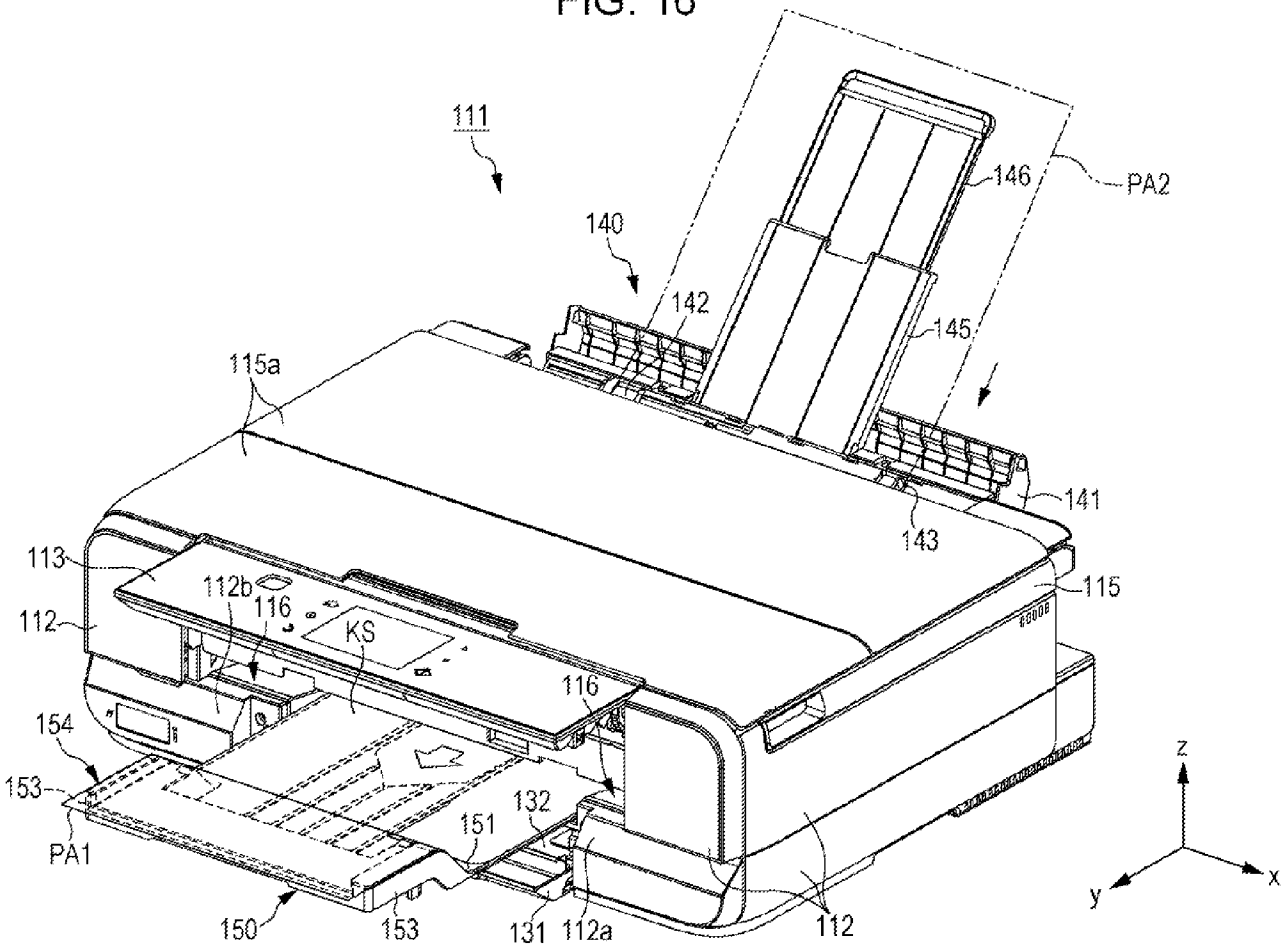
FIG. 16 is a perspective view showing the discharge state of a sheet fed from the sheet cassette to the medium receiving portion.
Figure 17:
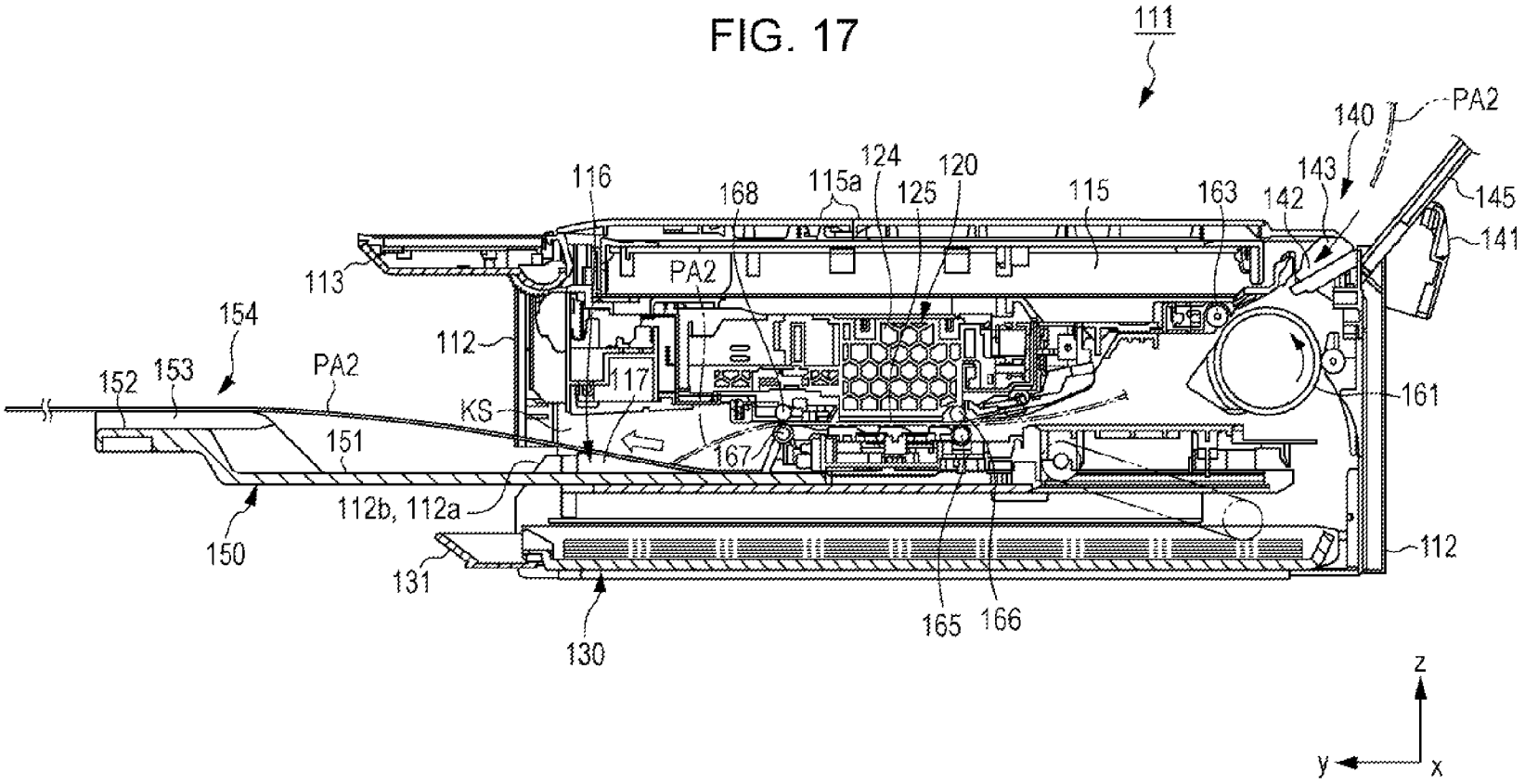
FIG. 17 is a cross-sectional view showing the discharge state of a sheet fed from the manual feeding portion to the medium receiving portion.

As shown in FIGS. 15 and 16, the sheet PA1 fed by the paper feeding roller 134 from the sheet cassette 130 is discharged to the medium receiving portion 150 from the recording portion 120 after recording is performed in the recording portion 120, as shown by a dotted and dashed line arrow in FIG. 15. The discharged sheet PA1 has a curved shape along the protrusion portion 154 (both lateral side edge portions 153) as shown by the solid line in FIG. 15 by the leading side in the discharge direction (sub-scanning direction Y side) being moved to the upper surface of both lateral side edge portions 153 of the protrusion portion 154 from the receiving surface 151 of the medium receiving portion 150. Accordingly, the discharged sheet PA1 is received by the medium receiving portion 150 by the movement in the discharge direction according to the curved shape being suppressed, even in a case in which the leading edge part thereof being in a state of being positioned further forward than the receiving surface 151.

For the sheet PA1 in a state of being received by the medium receiving portion 150, the entire sheet in the width direction that intersects the discharge direction thereof is received by the medium receiving portion 150 having a dimension of the width of the sheet PA1 or more. Accordingly, the sheet PA1 is in a state of being stably discharged to the medium receiving portion 150 by all regions in the width direction of the sheet PA1 being supported from the gravity direction side (lower side).

Also in a case in which the sheet PA2 (for example, an A4 size sheet) with the same width dimension as the sheet PA1 is fed from the manual feeding portion 140 as shown by the double dotted and dashed line in FIG. 16, the sheet PA2 is discharged similarly to the discharge state of the sheet PA1 fed from the sheet cassette 130 to the medium receiving portion 150. Accordingly, the sheet PA2 also attains a state of being stably discharged to the medium receiving portion 150.

Figure 18:
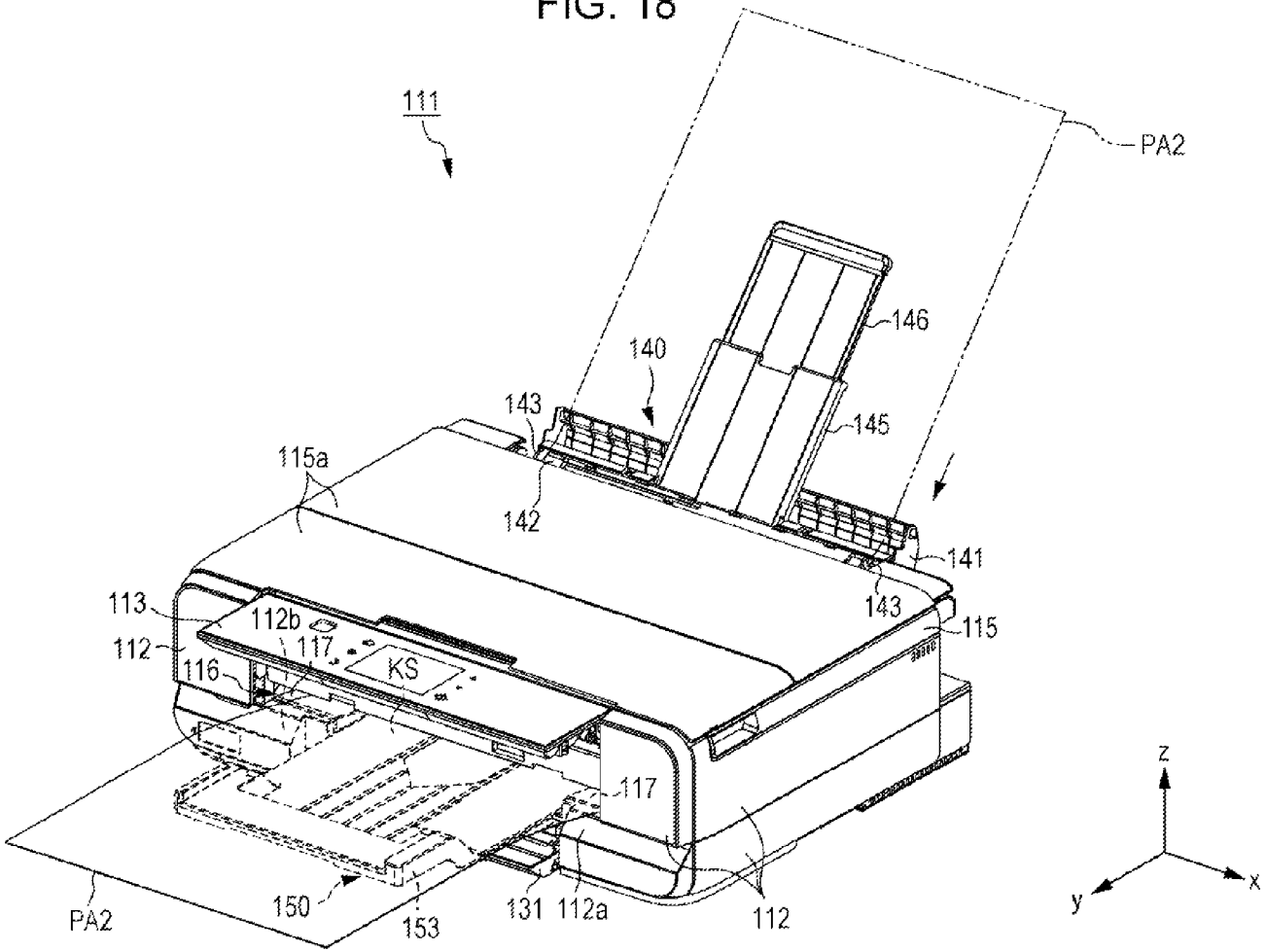
FIG. 18 is a perspective view showing the discharge state of a sheet fed from the manual feeding portion to the medium receiving portion.

Next, as shown in FIGS. 17 and 18, the sheet PA2 fed from the manual feeding portion 140 inserted in the insertion port 142 is discharged from the recording portion 120 to the medium receiving portion 150 after recording is performed in the recording portion 120. The leading edge portion in the discharge direction of the discharged sheet PA2 abuts on the inclined locations 117 of the medium support portion 116 provided on both sides of the medium receiving portion 150 in the width direction, as shown by the double dotted and dashed line in FIG. 17. As shown by the outlined arrow in FIG. 17, both side parts in the width direction in the leading edge portion in the discharge direction of the sheet PA2 moves toward the housing opening portion KS while being raised upward from the height of the receiving surface 151 along the inclined location 117. As a result, the sheet PA2 in which both sides of the leading edge portion in the discharge direction are raised further upward than the upper edge portion of the apparatus main body locations 112*a* and 112*b* by moving along the inclined location 117 passes through the housing opening portion KS without engaging with the apparatus main body locations 112*a* and 112*b*, as shown by the solid line in FIG. 17. In this way, the sheet PA2 is appropriately discharged to the medium receiving portion 150 without, for example, entering into a jammed state.

The center part in the width direction (main scanning direction X) that intersects with the discharge direction of the sheet PA2 discharged to the medium receiving portion 150 is received by the medium receiving portion 150 as shown in FIG. 18. In a case in which the leading edge part in the discharge direction thereof (sub-scanning direction Y) is in a state of being projected further forward from the protrusion portion 154 than the sheet PA1, the forward side of the sheet PA2 is better supported by both lateral side edge portions 153 of the protrusion portion 154 from the gravity direction (lower side) side than the intermediate position of the sheet PA2 in the discharge direction in the medium receiving portion 150. In other words, the drawing amount of the medium receiving portion 150 is set such that the position of the protrusion portion 154 (both lateral side edge portions 153) in the discharge direction becomes further to the forward side than the intermediate position of the sheet PA2 in the discharge direction. Accordingly, the sheet PA2 attains a state of being stably discharged to the medium receiving portion 150.

According to the above-described embodiment, the following effects can be obtained.

(1) It is possible to increase the maximum dimension in the width direction of the sheet PA (sheet PA2) able to be fed to the recording portion 120 by the manual feeding portion 140, and possible to continuously feed the sheet PA (sheet PA1) with high frequency and a comparatively small width dimension on which recording is performed to the recording portion 120 by the sheet cassette 130. Accordingly, for example, since it is not necessary to enlarge the medium receiving portion 150 provided in the liquid ejecting apparatus 111, it is possible to increase the maximum dimension in the width direction of the sheet PA that is able to be fed to the recording portion 120 and obtain a liquid ejecting apparatus 111 in which an increase in size is suppressed.

(2) Even if a sheet PA with a larger width dimension than the sheet PA (PA1) fed from the sheet cassette 130 is fed from the manual feeding portion 140, and it is possible to discharge the sheet PA to outside the apparatus main body 112 from the housing opening portion KS with a larger width dimension than the medium receiving portion 150. Accordingly, it is possible to obtain a liquid ejecting apparatus 111 in which an increase in size is suppressed, and to increase the maximum dimension in the width direction of the sheet PA that is able to be fed to the recording portion 120.

(3) The dimension of the medium receiving portion 150 is the maximum dimension in the width direction of the sheet PA1 or more, and formed smaller than the maximum dimension in the width direction of the sheet PA2. In so doing, in the medium receiving portion 150, it is possible to reliably receive the sheet PA fed from the sheet cassette 130, and possible to realize a liquid ejecting apparatus A11 in which a sheet PA fed from the manual feeding portion 140 is also able to be received by a medium receiving portion A50 in which an increase in size is suppressed.

(4) Since the housing opening portion KS as a medium discharge port is formed with the same dimension on both sides with the medium receiving portion 150 as a center in the width direction that intersects the discharge direction of the sheet PA, it is possible to discharge the sheet PA2 fed from the manual feeding portion 140 in the liquid ejecting apparatus 111 via the housing opening portion KS such that the medium receiving portion 150 is positioned in the center. Accordingly, it is possible for the sheet PA2 fed from the manual feeding portion 140 to be received by the medium receiving portion 150 with high probability.

(5) According to the inclined location 117 of the medium support portion 116, it is possible to raise both ends in the width direction of the leading edge portion in the discharge direction of the sheet PA2 to the antigravity direction side such that the sheet PA2 fed from the manual feeding portion 140 in the liquid ejecting apparatus 111 is caused to pass through the housing opening portion KS when discharged from the recording portion 120. Accordingly, it is possible for the sheet PA2 fed from the manual feeding portion 140 to be smoothly discharged to the medium receiving portion 150 without engaging with the apparatus main body locations 112*a* and 112*b*.

(6) It is possible to feed the sheet PA1 fed from the sheet cassette 130 with a large number of recording sheets in the liquid ejecting apparatus 111 to the recording portion 120 from the side of the direction in which the medium receiving portion 150 is provided with respect to apparatus main body 112. Accordingly, the liquid ejecting apparatus 111 is able to easily perform feeding of the sheet PA to the recording portion 120 and recovery of the sheet PA on which recording is performed is obtained by causing the discharge side in which the sheet PA is discharged from the recording portion 120 to be the opposing front side when a user operates the liquid ejecting apparatus 111.

(7) Since the medium receiving portion 150 allows recording on the medium by holding the medium different from the sheet PA fed from the sheet cassette 130 and the manual feeding portion 140, it is possible to diversity the media able to be recorded while being able to obtain a liquid ejecting apparatus 111 in which an increase in size is suppressed.

(8) The dimension in the width direction of the operation panel 113 arranged on the front surface side of the apparatus main body 112 is formed with the same dimension as that of the width of the housing opening portion KS. Accordingly, it is possible to suppress the dimension of the liquid ejecting apparatus 111 in the vertical direction (height direction), and make the apparatus thinner by causing the width of the operation panel 113 to be the same width as the housing opening portion KS, that is, wider than the sheet cassette 130, while being able to obtain a liquid ejecting apparatus 111 in which an increase in size is suppressed.

(9) In a case in which recording is performed on the sheet PA2 fed from the manual feeding portion 140 in the liquid ejecting apparatus 111, it is possible for the housing opening portion KS to be exposed by the operation panel 113 and the front panel 131 being displaced. Meanwhile, in a case in which recording is not performed on the sheet PA2 fed from the manual feeding portion 140, it is possible to prevent foreign materials and the like from entering the recording portion 120 from, for example, the housing opening portion KS.

(10) Since the manual feeding portion 140 is provided in the reversing unit 160 as a removable member, it is possible to remove the sheet PA with the reversing unit 160 from the apparatus main body 112 even if the sheet PA fed from the manual feeding portion 140 is in a jammed state in the transport path, while being able to obtain a liquid ejecting apparatus 111 in which an increase in size is suppressed. Accordingly, it is possible to perform a jam process by easily removing the sheet PA in a jammed state.

(11) Since the removable member is the reversing unit 160 in which the front and rear of the sheet PA supplied to the recording portion 120 is reversed, a liquid ejecting apparatus 111 able to record on both surfaces of the sheet PA, while being able to obtain a liquid ejecting apparatus 111 in which an increase in size is suppressed.

(12) Since a plurality of sheet cassettes 130 is provided, it is possible to increase the diversity of the sheets PA able to be fed to the recording portion 120, while being able to obtain a liquid ejecting apparatus 111 in which an increase in size is suppressed.

(13) Since the ink tank 122 is provided outside the apparatus main body 112, a liquid ejecting apparatus 111 is able to feed ink in large volumes to the recording portion 120, while being able to obtain an apparatus main body 112 in which an increase in size is suppressed.

The embodiment may be modified as below.

In the embodiment, the sheet cassette 130 may not necessarily be provided on the front side that is the discharge direction side of the sheet P discharged to the medium receiving portion 150 in the apparatus main body 112. For example, the sheet cassette 130 may be provided on the rear side of the apparatus main body 112 on which the manual feeding portion 140 is positioned, or may be provided on the lateral side. The manual feeding portion 140 may not necessarily be provided on the side in the opposite direction to the discharge direction of the sheet PA in the apparatus main body 112. For example, the manual feeding portion 140 may be provided on the front side on which the sheet cassette 130 is positioned in the apparatus main body 112, or may be provided on the lateral side that is the main scanning direction X side.

In the embodiment, the operation panel 113 or the front panel 131 may not necessarily be provided as a displacement member able to displace between a closed position at which the housing opening portion KS is not exposed and an open position at which the housing opening portion KS is exposed. For example, in the liquid ejecting apparatus 111, in a case of including a apparatus main body 112 with a configuration in which the housing opening portion KS is in a normally exposed state, it is not necessary to include a displacement member able to displace by swinging or the like.

In the embodiment, the medium support portion 116 may not necessarily be formed with an inclined location 117. For example, in the leading edge portion in the discharge direction of the sheet PA2 discharged from the recording portion 120 by the discharge rollers 167 and 168, at the time point in which both end portions in the width direction abut on the medium support portion 116, in the case of a configuration in which the abutting position of the leading edge portion of the sheet PA2 in the discharge direction is positioned above the apparatus main body locations 112*a* and 112*b*, the upper surface of the medium support portion 116 may be a substantially level location. Alternatively, an inclined location with an upward slope by which the sheet PA2 discharged toward the housing opening portion KS is gradually lowered to the gravity direction side may be used.

According to the modification example, it is possible to obtain the following effects in place of the effects (5).

(14) In the liquid ejecting apparatus 111, it is possible to support both end portions of the sheet PA2 in the width direction from the gravity direction side such that the sheet PA2 fed from the manual feeding portion 140 is caused to pass through the housing opening portion KS. Accordingly, it is possible for the sheet PA2 fed from the manual feeding portion 140 to be reliably discharged to the medium receiving portion 150.

In the embodiment, the medium support portion 116 may not necessarily be provided at both ends in the width direction that intersects the discharge direction of the sheet PA at the housing opening portion KS. For example, in a case of a configuration in which the housing opening portion KS is unchanged in the exposed state without providing the apparatus main body locations 112*a* and 112*b* at both sides of the sheet cassette 130 in the width direction, since it is not necessary to raise the sheet PA2 that is to avoid engagement with the apparatus main body locations 112*a* and 112*b*, the medium support portion 116 may be not provided.

In the embodiment, the housing opening portion KS may not necessarily be formed with the same dimension on both sides thereof in the width direction that intersects the discharge direction of the sheet PA with the medium receiving portion 150 as a center. That is, as long as the sheet PA2 is received by the medium receiving portion 150, the housing opening portion KS may be formed to be deflected to the side in one direction from the center with respect to the medium receiving portion 150.

In the embodiment, for the dimension of the medium receiving portion 150 in the width direction that intersects the discharge direction of the sheet P, it is preferable that the dimension of the sheet PA on the downstream side in the direction along the discharge direction be the dimension on the upstream side or less. Here, although not shown in the drawings, for example, in a case of adopting a two-stage type (multi-stage type) medium receiving portion 50, the medium receiving portion 150 have such a configuration, as disclosed in JP-A-2012-240813 above.

According to the modification example, it is possible to obtain the following effects in addition to the effects of the embodiments.

(15) In the medium receiving portion 150, since the discharged sheet PA2 is received by the wide part on the upstream side, the probability of being able to stably receive the discharged sheet PA2 is high. Since the area of the medium receiving portion 150 is suppressed from becoming larger, a reduction in costs of the liquid ejecting apparatus 111 is possible, along with suppressing an increase in size of the liquid ejecting apparatus 111.

In the embodiment, the liquid ejecting apparatus 111 may not necessarily be provided with a medium receiving portion 150 that receives the medium discharged from the recording portion 120. For example, the medium receiving portion 150 is not stored to be able to be drawn out from the apparatus main body 112, and may be configured as a separate body from the apparatus main body 112. Alternatively, the medium receiving portion 150 that receives the sheet PA discharged from the recording portion 120 may be configured to be provided as a separate apparatus from the liquid ejecting apparatus 111. Thus, it is possible to obtain a small liquid ejecting apparatus 111 able to record on a large sized sheet PA.

In the embodiment, the maximum size of the sheet PA1 and the maximum size of the sheet PA2 are not necessarily limited to A4 size and A3 size, respectively. For example, the maximum size of the sheet PA1 and the maximum size of the sheet PA2 may be postcard size and A5 size, respectively, or the maximum size of the sheet PA1 and the maximum size of the sheet PA2 may be A5 size and A4 size, respectively. In short, in the width direction that intersects the feeding direction of the sheet P, the dimension of the sheet PA2 may be larger than the dimension of the sheet 1.

In the embodiment, the dimension of the sheet PA2 may be smaller than the dimension of the sheet PA1. In this case the discharged paper receiving portion may be provided at a separate location from the present embodiment, for example, on the upper surface of the apparatus main body A12.

In the embodiment, the opening/closing lid 141 that covers the insertion port 142 to be openable/closable or the support plates 145 and 146 may not necessarily be provided on the upstream edge in the feeding direction of the sheet PA2 fed from the manual feeding portion 140, that is, at the insertion port 142.

In the embodiment, the medium is not limited to the sheet, and may be a plate-like member formed from a material such as a metal plate, a resin plate, or linen. That is, if the member is able to be transported in the transport path and able to be recorded in the recording portion 20, it is possible to adopt the member as the medium.

In the embodiment, the liquid ejecting apparatus 111 may have an off-carriage type of configuration in which the ink cartridge is not mounted on the carriage 124. A configuration in which the ink tank 122 is arranged inside the apparatus main body 112 may be adopted. A configuration may be adopted in which only a specified color of ink is arranged outside the apparatus main body 112.

The ink tank 122 as a liquid accommodating body may be a so-called refillable type into which ink is able to be introduced, or may be a so-called exchangeable pack type in which an ink pack in which ink is accommodated in a pack (bag) is exchanged.

In the embodiment, the liquid ejecting apparatus 111 is not limited to a serial type recording portion 120 in which the liquid ejecting head 125 moves in the main scanning direction X along with the carriage 124, and a line head type recording portion 120 able to print in a range of the maximum width of the sheet even with the liquid ejecting head 125 fixed may be provided.

In the embodiment, the liquid ejecting apparatus 111 may be not provided with the image reading portion 115, or may be provided with function as a FAX device, a copy device or the like, along with the recording portion 120.

In the embodiment, although not shown, an ink absorbing body for absorbing ink shifted from the end portion of the sheet PA and recovering waste ink discharged for maintenance of the liquid ejecting head 125 may be provided outside the apparatus main body 112.

The recording head that performs recording, may be not only a type that is moved to reciprocate by the carriage, but also a fixed type, and a so-called line head type of head.

The supply source of the ink that is a liquid discharged from the recording head may be an ink cartridge mounted on the carriage, or may be an ink accommodating body provided outside the carriage. The ink accommodating body outside the carriage may be provided inside the housing that configures the external appearance of the recording apparatus, or may be provided outside the housing.

When supplying ink to the recording head from outside the housing, it is necessary that the ink supply tube for supplying ink be routed inside the housing. Thereby, a hole or notch may be provided in the housing, and an ink supply tube may pass through the hole or notch. Alternatively, a boss or the like may be erected such that an opening/closing body, such as a scanner unit or cover, provided on the housing to be able to open and close does not completely close with respect to the housing, and the tube may be routed inside the housing using the gap formed by the boss. In so doing, it is possible to ensure the supply of ink in the channel of the ink supply tube.

The entire disclosure of Japanese Patent Application No. 2013-126342 filed on Jun. 17, 2013 and No. 2013-193370 filed on Sep. 18, 2013 are expressly incorporated by reference herein.

What is claimed is:

1. A recording apparatus that performs recording on a medium, comprising:

a first feeding portion that feeds the medium;

a recording portion that performs recording on the medium;

a medium receiving portion that receives the medium discharged from the recording portion;

a first transport path that transports the medium from the first feeding portion to the medium receiving portion via the recording portion; and a second transport path that is a path for reversing the medium, on the surface of which recording is performed, and for performing recording on the rear surface, wherein the second transport path is branched from a branching portion of the first transport path, and is merged with a merging portion of the first transport path which is positioned upstream from the branching portion, wherein the width of the second transport path is narrower than the width of the first transport path.

2. The recording apparatus according to claim 1, wherein the second transport path includes a reversing path which reverses the medium, and wherein the reversing path merges with the merging portion of the first transport path.

3. The recording apparatus according to claim 2, wherein, at least a portion of the second transport path is formed by a unit that is attachable and detachable with respect to an apparatus main body that includes the recording portion.

4. The recording apparatus according to claim 1, wherein a region occupied by the recording portion and the region occupied by the second transport path at least partially overlap with each other in the height direction of the apparatus.

5. The recording apparatus according to claim 1, wherein a branching portion where the branching portion of the first transport path is positioned on the downstream side in the transport direction of the medium with respect to the recording portion during execution of recording.

6. The recording apparatus according to claim 1, further comprising:

a second feeding portion that feeds the medium, wherein the medium fed via the second feeding portion joins to the second transport path.

7. The recording apparatus according to claim 1, wherein the first feeding portion is a manual feeding portion for manually feeding the medium.

8. The recording apparatus according to claim 1, wherein the second feeding portion is a sheet cassette, and wherein a plurality of sheet cassettes is provided.

9. The recording apparatus according to claim 1, wherein the feeding reference position of the medium in the width direction of the feeding portion is the center.

10. The recording apparatus according to claim 1, wherein the recording portion includes a liquid supply tube having a moving body that performs recording by ejecting a liquid to a sheet-like medium, guides the liquid sent from a liquid accommodating body in which the liquid is accommodated to the recording portion, and includes a deforming movable portion that deforms so as to follow the movement of the moving body, and wherein at least a portion of the liquid accommodating body is arranged outside the apparatus main body.

11. A recording apparatus that performs recording on a medium, comprising, in an apparatus main body:

a recording portion that performs recording on the medium;

a medium discharge port for discharging the medium on which recording is performed, a first feeding portion that includes an insertion port for the medium, and that is able to feed the medium inserted from the insertion port to the recording portion;

a first transport path that extends from the insertion portion of the first feeding portion to the medium discharge port via the recording portion;

a second feeding portion that includes a mounting portion on which a plurality of sheets of the medium is mountable in a stacked state, and that is able to feed and reverse the medium from on the mounting portion to the recording portion; and a second transport path that extends from the second feeding portion, and that merges with the first transport path, wherein the mounting portion of the second feeding portion is positioned below the recording portion, and wherein the width of the first transport path is larger than the width of the second transport path.

12. The recording apparatus according to claim 11, further comprising:

wherein the medium discharge port is larger than the width of the mounting portion of the second feeding portion.

13. The recording apparatus according to claim 11, further comprising:

a medium receiving portion that receives the medium discharged from the recording portion, wherein the dimension of the medium receiving portion in the width direction that intersects the discharge direction of the medium is smaller than the width of the first transport path.

14. The recording apparatus according to claim 13, wherein a medium support portion that supports the medium fed from the first feeding portion from the gravity direction side on both sides in the width direction that intersects the discharge direction of the medium is provided on the medium discharge port.

15. The recording apparatus according to claim 14, wherein an inclined location of an uphill slope in which the medium discharged from the recording portion towards the medium discharge port is gradually raised to the antigravity direction side is formed on the medium support portion.

16. The recording apparatus according to claim 11, wherein an operation panel is arranged on a front surface side of the apparatus main body that is the discharge direction side of the medium discharged from the recording portion, and wherein the dimension of the operation panel in the width direction is formed with the same dimension as the dimension in the width of the medium discharge port.

* * * * *